US012716226B2

(12) United States Patent
Stout

(10) Patent No.: US 12,716,226 B2
(45) Date of Patent: Aug. 25, 2026

(54) BLIND INSTALL DRAIN FOR BATH OR SHOWER

(71) Applicant: Kohler Co., Kohler, WI (US)

(72) Inventor: Kenneth Stout, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 18/915,095

(22) Filed: Oct. 14, 2024

(65) Prior Publication Data

US 2025/0116104 A1 Apr. 10, 2025

Related U.S. Application Data

(63) Continuation of application No. 17/112,942, filed on Dec. 4, 2020, now Pat. No. 12,116,766.

(60) Provisional application No. 62/949,942, filed on Dec. 18, 2019.

(51) Int. Cl.
*E03F 5/04* (2006.01)
*A47K 1/14* (2006.01)

(52) U.S. Cl.
CPC ..... *E03F 5/0407* (2013.01); *A47K 1/14* (2013.01)

(58) Field of Classification Search
CPC ..... E03F 5/0407; A47K 1/14
See application file for complete search history.

(56) References Cited

U.S. PATENT DOCUMENTS 4,103,372 A 8/1978 Cuschera
4,146,939 A 4/1979 Izzi
6,108,828 A 8/2000 Cheng
7,735,112 B2 6/2010 Kim et al.
8,316,474 B2 11/2012 Kang
8,347,906 B1 1/2013 Ismert et al.
9,010,363 B2 4/2015 Huber
(Continued)

FOREIGN PATENT DOCUMENTS

KR 101281612 B1 7/2013
KR 101679787 B1 11/2016

OTHER PUBLICATIONS

Anonymous: Schluter®-KERDI-DRAIN is a floor drain specifically designed to allow connections to Schluter®-KERDI or other load-bearing, bonded waterproof membranes. Retrieved from the internet: URL: https://www.schluter.com/schluter-us/en_US/Shower-System/Drains/Schluter%C2%AE-KERDI-DRAIN/p/KERDI_DRAIN?facets=false on Aug. 30, 2019 (6 pages).

*Primary Examiner* — P. Macade Nichols
(74) *Attorney, Agent, or Firm* — Foley & Lardner LLP

(57) ABSTRACT

A drain installation assembly includes a drain body and a drain coupling. The drain coupling is configured to be inserted into a drain opening of a wash basin from a top side of the wash basin. The drain coupling comprises a first coupling end and a second coupling end, the second coupling end positioned opposite to the first coupling end. The drain coupling further includes a squeeze portion positioned between the first coupling end and the second coupling end, the squeeze portion formed of a flexible material. The drain body comprises a body flange extending radially away from the drain body. The squeeze portion is configured to deform, so as to define a squeeze bulge when the drain coupling is coupled to the drain body, the squeeze bulge having a diameter greater than a diameter of the drain opening of the wash basin.

20 Claims, 24 Drawing Sheets

(56) References Cited

U.S. PATENT DOCUMENTS

| | | | | |
|---|---|---|---|---|
| 9,422,707 | B2 | 8/2016 | Hull | |
| 9,422,708 | B2 | 8/2016 | Hull | |
| 9,714,504 | B2 | 7/2017 | Bird et al. | |
| 12,116,766 | B2 * | 10/2024 | Stout | A47K 1/14 |
| 2003/0000590 | A1 * | 1/2003 | Chen | F16L 55/132<br>138/92 |
| 2008/0290012 | A1 * | 11/2008 | Shih | E03F 5/0407<br>210/163 |
| 2016/0348352 | A1 | 12/2016 | Hull | |
| 2018/0087248 | A1 | 3/2018 | Buchan et al. | |
| 2019/0055722 | A1 | 2/2019 | Zhang | |

* cited by examiner

BLIND INSTALL DRAIN FOR BATH OR SHOWER

CROSS-REFERENCE TO RELATED PATENT APPLICATIONS

This application is a Continuation of U.S. patent application Ser. No. 17/112,942, filed on Dec. 4, 2020, which claims the benefit of and priority to U.S. Provisional Application No. 62/949,942, filed on Dec. 18, 2019, the entire disclosures of which are hereby incorporated by reference herein.

BACKGROUND

The present application relates generally to the field of bath and shower drain installation assemblies.

When a person is installing a bathtub, that person may need access to the underside of the bathtub in order to install the drain to/in the drain opening of the bathtub. Once installed, the drain my project from the underside of the bathtub. The bathtub then would be lifted up, the drain opening lined up with a drain pipe in the floor, and then slid onto or over the drain pipe. This installation process can be difficult for a single person to do on their own. And if the bathtub is heavy, such as for an iron stand-alone bathtub, more than two people may be required to lift the bathtub.

Accordingly, it may be desirable to use a drain that can be installed entirely from the top-side of the bathtub (e.g., without requiring access to the underside of the bathtub.)

SUMMARY

At least one embodiment relates to a drain installation assembly. The drain installation assembly includes a drain body and a drain coupling. The drain coupling is configured to be inserted into a drain opening of a wash basin from a top side of the wash basin. The drain coupling comprises a first coupling end and a second coupling end, the second coupling end positioned opposite to the first coupling end. The drain coupling further includes a squeeze portion positioned between the first coupling end and the second coupling end, the squeeze portion formed of a flexible material. The drain body comprises a body flange extending radially away from the drain body. The squeeze portion is configured to deform so as to define a squeeze bulge when the drain coupling is coupled to the drain body, the squeeze bulge having a diameter greater than a diameter of the drain opening of the wash basin.

At least one embodiment relates to a drain assembly for coupling a wash basin to a drain pipe from above the wash basin. The drain assembly includes a drain coupling and a drain body configured for coupling to the drain coupling. The drain coupling is configured to be inserted into a drain opening of the wash basin from a top side of the wash basin. The drain coupling is also configured to extend into the drain pipe.

At least one embodiment relates to a method of installing a drain assembly in a wash basin. The method incudes inserting a drain coupling into a drain opening in the wash basin from a top side of the wash basin, and inserting a drain body into the drain coupling, and coupling the drain body to the drain coupling.

DETAILED DESCRIPTION

Referring generally to the FIGURES, a blind drain installation assembly is shown according to various exemplary embodiments. The blind drain installation assembly is structured to couple a drain opening in a wash basin to a drain pipe in a floor without requiring access to the underside of the wash basin. This may allow an installer of the wash basin to install the blind drain installation assembly without having to lift the wash basin off the floor. Instead, the installer may slide the wash basin over the drain pipe in the floor and line up the drain pipe with the drain opening in the wash basin. Doing so may save time and avoid injury.

Figure 1:
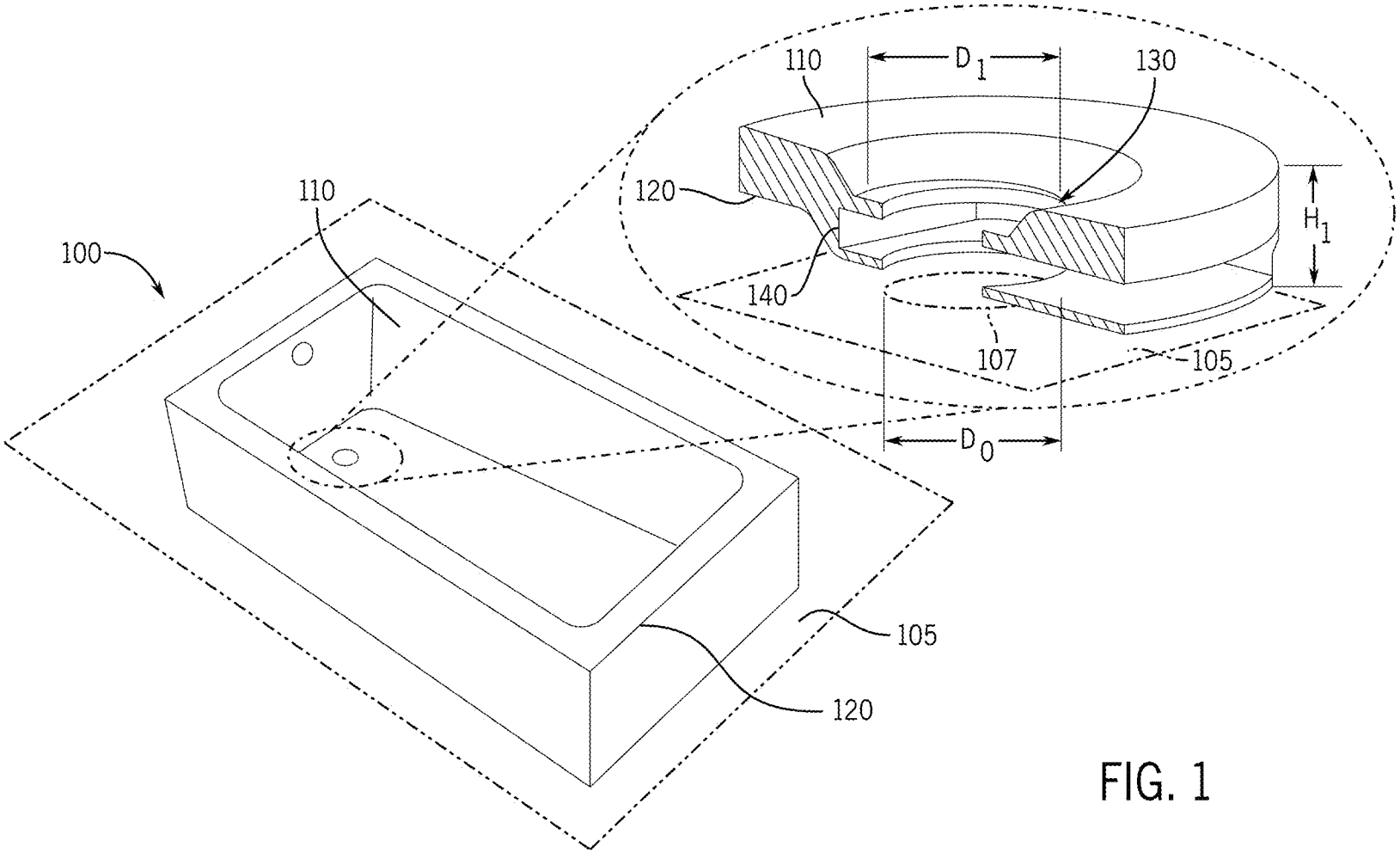
FIG. 1 shows a wash basin according to an example embodiment.

Referring to FIG. 1, a wash basin (e.g., tub, bathtub, basin, bath, sink, shower, shower floor, etc.) 100 is shown according to an exemplary embodiment. The wash basin 100 may be tiled, poured cement, metal, plastic, porcelain, acrylic, acrylic resin, fiberglass, reinforced fiber cloth, polyester, vitreous enamel, cast iron, porcelain enameled steel, stone, stone resin, or similar products and composites. The wash basin 100 rests on a floor (e.g., subfloor, ground, surface, etc.) 105. The floor 105 includes a floor opening (e.g., hole, cut-out, orifice, etc.) 107 through which drain plumbing may extend. The floor opening 107 is defined by a floor opening diameter $D_0$. The wash basin 100 is configured to receive a flow of water from a faucet (e.g., shower, shower head, spray head, spout, etc.). The wash basin 100 has a top (e.g., inner, first, etc.) basin surface 110 and a bottom (e.g., outer, second, etc.) basin surface 120. The top basin surface 110 and the bottom basin surface 120 are separated from one another by a thickness of the wash basin 100 shown as a basin thickness $H_1$. Portions of the top basin surface 110 and the bottom basin surface 120 may be substantially parallel to one another. The top basin surface 110 may be shaped into a cavity configured to hold water. The top basin surface 110 is resistant to water corrosion (e.g., warping, rusting, dissolving, etc.) and may be manufactured from plastic, fiberglass, stone, stone resin, porcelain, or various other suitable surfaces. Extending through both the top basin surface 110 and the bottom basin surface 120 is a drain opening (e.g., orifice, hole, opening, drain, etc.) 130. The drain opening 130 has a drain opening diameter $D_1$ proximate both the top basin surface 110 and the bottom basin surface 120. The top basin surface 110 may be configured to direct a flow of water from the faucet toward the drain opening 130. A portion of the top basin surface 110 proximate the drain opening 130 may be recessed (e.g., depressed, sunken, funneled, etc.) to aid in directing a flow of water from the wash basin 100 toward the drain opening 130. The drain opening 130 is configured to accept a drain assembly, such as a blind drain installation assembly 200 as shown in FIG. 2.

Disposed between the top basin surface 110 and the bottom basin surface 120, proximate the drain opening 130, may be a cavity (e.g., channel, aperture, etc.), shown as an overflow channel 140.

Figure 2:
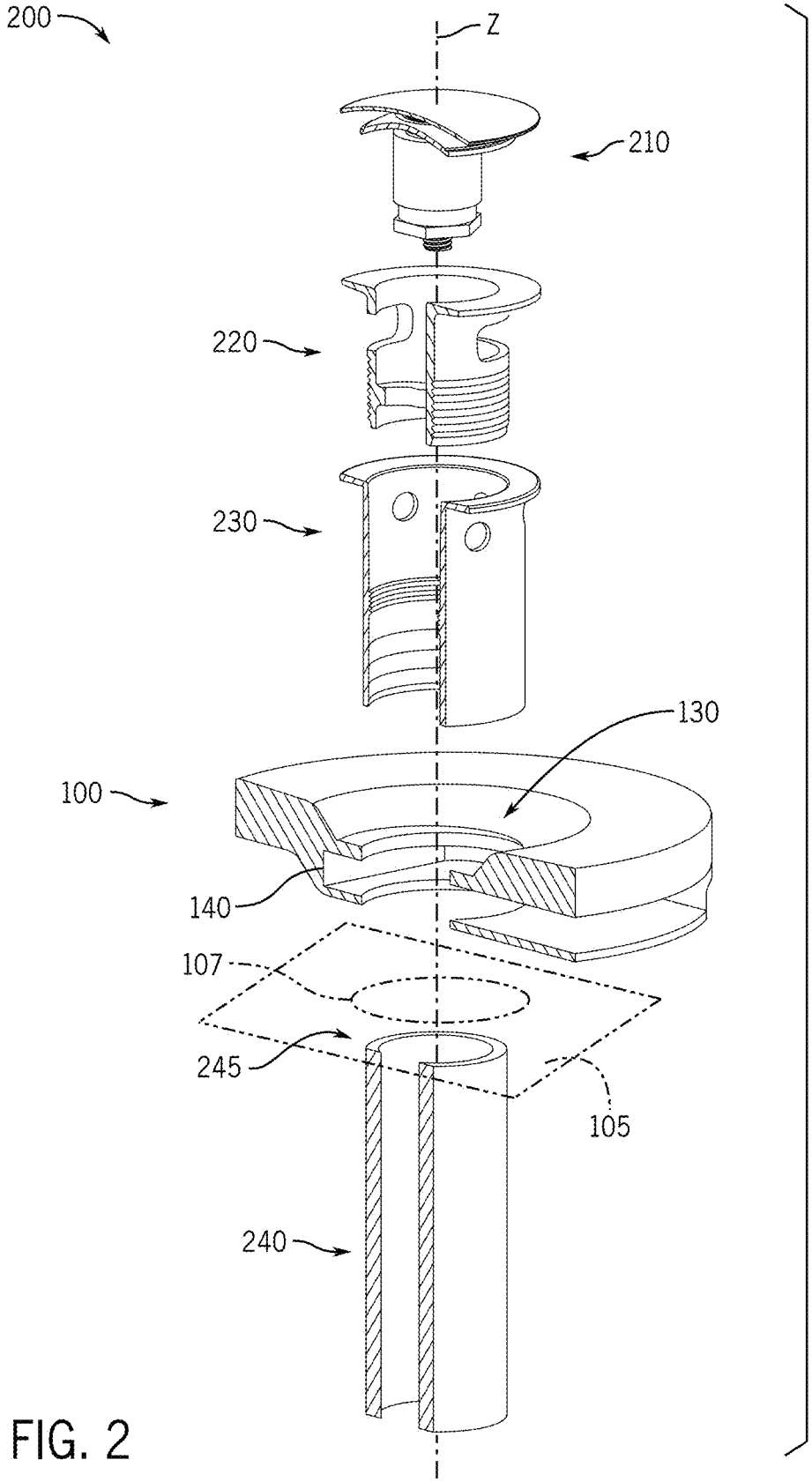
FIG. 2 shows an exploded view of a blind drain installation assembly according to an example embodiment.

Referring to FIG. 2, an exploded view of the blind drain installation assembly 200 is shown, according to an example embodiment. The blind drain installation assembly 200 includes a drain body 220 and a drain coupling 230. In some embodiments, the blind drain assembly includes the drain body 220, the drain coupling 230, and a toe tap 210. The toe tap (e.g., stopper, plug, drain plug, toe touch, foot actuated stopper) 210 may be any variety of drain stopper, including a lift-and-turn stopper, push-and-pull stopper, flip-it stopper, trip lever stopper, pop-up stopper, or similar drain plug or stopper. The toe tap 210 is configured to be disposed within and received by the drain body 220. The drain body 220 receives and is removably coupled to (e.g., threadingly coupled to, etc.) the toe tap 210. A portion of the toe tap 210 extends out of the drain body 220. The drain body 220 and the toe tap 210 are configured to cooperate to selectively prevent a flow of water, such as from the wash basin 100, through the drain body 220. The drain body 220 is configured to be disposed within and threadingly coupled to the drain coupling 230. The drain coupling 230 may be manufactured from an elastomer, polymer, plastic, wood, or any one of a variety of materials able to be cast, milled, forged, molded, or carved. The drain coupling 230 is configured to accept both the drain body 220 and the toe tap 210. The drain coupling 230, the drain body 220, and the toe tap 210 cooperate to selectively prevent a flow of water through the drain coupling 230. The blind drain installation assembly 200 is configured to be received by the drain opening 130. The drain opening 130 may interface with the drain coupling 230, the drain body 220, and the toe tap 210.

Disposed beneath the wash basin 100 is a drain pipe (e.g., drain plumbing, drain tube, pipe, conduit, etc.) 240 including a top drain pipe portion 245. The top drain pipe portion 245 may be configured to extend through the floor opening 107 such that the top drain pipe portion 245 is disposed above the floor 105. In some embodiments, the top drain pipe portion 245 is even (e.g., flush) with the floor 105 and does not extend above the floor 105. This may be desirable during the installation of the wash basin 100. The wash basin 100 may be heavy-so heavy that lifting the wash basin 100 may be difficult or dangerous. With the drain pipe 240 flush with the floor 105, the wash basin 100 may be slid over the floor opening 107 to line up the drain opening 130 with (e.g., make the drain opening 130 concentric about) the drain pipe 240. The drain coupling 230 is configured to slide through the drain opening 130 and surround the drain pipe 240. The drain coupling 230 and the drain pipe 240 cooperate to prevent a flow of water from flowing between the drain pipe 240 and the drain coupling 230. In some embodiments, the drain pipe 240 and the drain coupling 230 are coupled using a retention ring or compression ring. In other embodiments, the drain coupling 230 forms a water-tight friction fit with the drain pipe 240. In some embodiments, the elasticity of the material used to form the drain coupling 230 creates a watertight seal between the drain coupling 230 and the drain pipe 240.

Figure 3B:
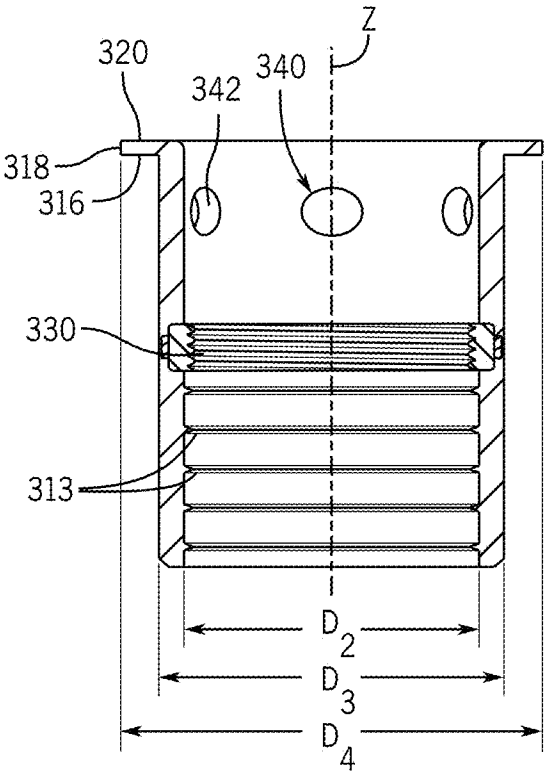
FIG. 3B shows a side, cross-section view of the portion of the blind drain installation assembly of FIG. 3A.
Figure 3A:
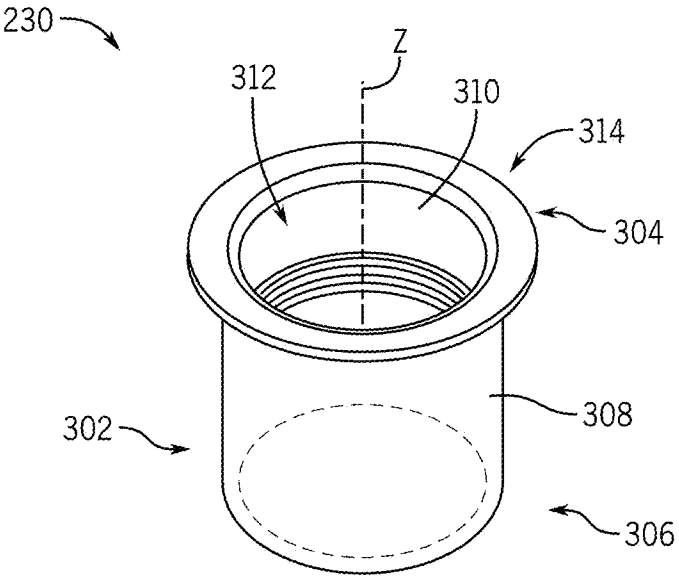
FIG. 3A shows a perspective view of a portion of the blind drain installation assembly of FIG. 2.

Turning to FIGS. 3A and 3B, an exemplary embodiment of the drain coupling 230 is shown. The drain coupling 230 includes a generally annular first body 302 having a first upper end 304, a first lower end 306, a first outer surface 308, and a first inner surface 310. The first outer surface 308 and the first inner surface 310 may be concentric about the central axis Z. The first inner surface 310 defines an orifice (e.g., a flow path, etc.), shown as a coupling opening 312 configured to accept the drain pipe 240 and the drain body 220. The coupling opening 312 is concentric about a central axis Z.

The first inner surface 310 is configured to interface with the drain pipe 240 and provide a sealant such that a water-tight seal is formed between the drain coupling 230 and the drain pipe 240. The drain coupling 230 may include a plurality of annular projections 313 extending laterally away from the first inner surface 310 and toward the central axis Z. As shown in FIG. 3B, the plurality of annular projections 313 are disposed between the first upper end 304 and approximately half-way between the first upper end 304 and the first lower end 306. The plurality of annular projections 313 may be integrally manufactured to the drain coupling 230. In some embodiments, the plurality of annular projections 313 are manufactured separately and later coupled to the drain coupling 230. The drain coupling 230 may be formed from a compressible material (e.g., neoprene, rubber, etc.) or other suitable material configured to provide sealing engagement between the first inner surface 310 and the drain pipe 240. In some embodiments, the drain coupling 230 may be coupled to the drain pipe 240 such that the drain coupling 230 stays in place relative to the drain pipe 240 as the wash basin 100 is moved around relative to the drain pipe 240.

Figure 3C:
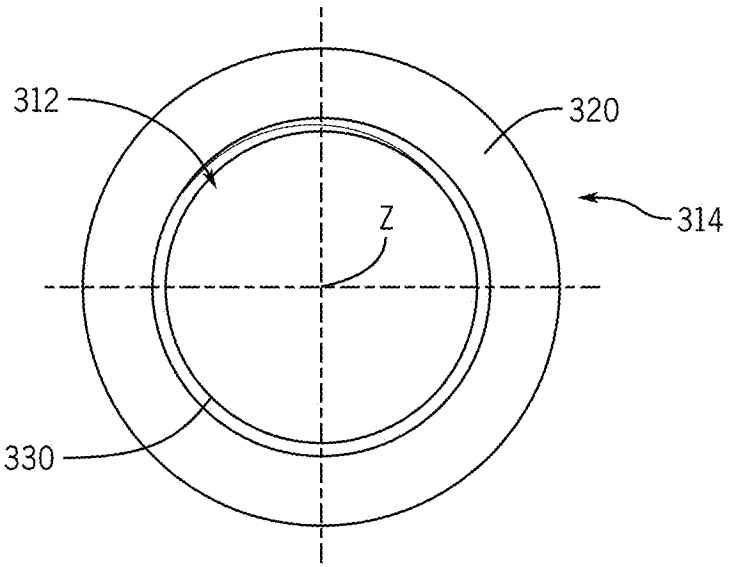
FIG. 3C shows a top view of the portion of the blind drain installation assembly of FIG. 3A.

Proximate the first lower end 306, the first inner surface 310 has a second diameter $D_2$. The first inner surface 310 maintains a circular cross-section of the second diameter $D_2$ extending from the first lower end 306 to the first upper end 304. In some embodiments, the diameter of the first inner surface 310 proximate the first upper end 304 is different (e.g., greater, lesser, etc.) than the second diameter $D_2$. The first inner surface 310 is configured to accept the drain body 220. The first inner surface 310 is also configured to allow a flow of water to pass through. FIG. 3C shows a generally annular coupling opening 312, although according to other embodiments, the coupling opening 312 may be elliptical, hexagonal, octagonal, or otherwise similar to the shape of the drain pipe 240. Proximate the first lower end 306, the first outer surface 308 has a third diameter $D_3$. The first outer surface 308 maintains a circular cross-section of the third diameter $D_3$ extending from the first lower end 306 to the first upper end 304. In some embodiments, the first lower end 306 and the first upper end 304 have different diameters. The third diameter $D_3$ is less than both the drain opening diameter $D_1$ and the floor opening diameter $D_0$ such that drain coupling 230 can be extended through the drain opening 130 and the floor opening 107.

A generally annular first flange 314 extends laterally outwardly from (e.g., orthogonally to) the first outer surface 308. As shown in FIG. 3B, the first flange 314 extends from the first upper end 304 of the first body 302. In some embodiments, the first flange 314 may extend outwardly from the first outer surface 308 at other heights such that at least a portion of the first body 302 extends above the first flange 314 (e.g., between the first flange 314 and the first upper end 304). The first flange 314 has a fourth diameter $D_4$. The fourth diameter $D_4$ is greater than the drain opening diameter $D_1$. The first flange 314 is configured to interface with the top basin surface 110 to form a watertight seal such that a flow of water is not able to exist between the top basin surface 110 and the first flange 314.

The first flange 314 includes a first flange first surface 316, a first flange second surface 318, and a first flange third surface 320. The first flange first surface 316 is disposed at an underside of the first flange 314 and is configured to cooperate and interface with the top basin surface 110 such that a water-tight seal is created between the first flange 314 and the top basin surface 110. The first flange first surface 316 extends laterally outwardly from and is generally perpendicular to and contiguous with the first outer surface 308. In some embodiments, the first flange first surface 316 projects outwardly from the first outer surface 308 at an angle that is not perpendicular. The first flange second surface 318 is contiguous with the first flange first surface 316. The first flange second surface 318 may be concentric about the center axis Z and may have the fourth diameter $D_4$. The first flange second surface 318 may be parallel with the first outer surface 308. The first flange third surface 320 is disposed on a top side of the first flange 314. The first flange third surface 320 is contiguous with the first flange second surface 318 and may be parallel to the first flange first surface 316. The first flange third surface 320 is configured to interface with a portion of the drain body 220 to create a watertight seal between the drain coupling 230 and the drain body 220. The first flange third surface 320 is contiguous with the first inner surface 310. The first flange third surface 320 and the first inner surface 310 may meet at a corner. In some embodiments, the corner is chamfered (e.g., filleted, rounded, blunted, etc.) such that the transition between the first flange third surface 320 and the first inner surface 310 is uninterrupted (e.g., smooth, rounded, etc.).

The drain coupling 230 further includes a generally annular flange shown as coupling threads 330. The coupling threads 330 interrupt the first inner surface 310 such that a portion of the first inner surface 310 exists between the first upper end 304 and the coupling threads 330. As shown in FIG. 3B, the coupling threads 330 are disposed approximately half-way between the first upper end 304 and the first lower end 306. In some embodiments, the coupling threads 330 are disposed nearer to the first lower end 306 than the first upper end 304, and vice versa. In some embodiments, the plurality of annular projections 313 are disposed between the coupling threads 330 and the first lower end 306. The coupling threads 330 may be manufactured from brass, steel, aluminum, plastic, titanium, rubber, or similar materials. The coupling threads 330 may be manufactured into the first inner surface 310 such that the drain coupling 230 and the coupling threads 330 are a single body (e.g., all one piece, etc.). In some embodiments, the coupling threads 330 are manufactured separately from the drain coupling 230 and later coupled to the first inner surface 310 by over-molding, fasteners, interference fit, friction, adhesives, glue, or by similar coupling means. The coupling threads 330 may be concentric about the central axis Z. The coupling threads 330 may define a diameter slightly less than the second diameter $D_2$. In some embodiments, the coupling threads 330 define a diameter equal to the second diameter $D_2$. The coupling threads 330 are configured to threadingly couple to the drain body 220. Prior to threading together the drain body 220 and the coupling threads 330, an adhesive (e.g., thread sealant, plumber's tape, Teflon tape, etc.) may be applied to either the coupling threads 330, the drain body 220, or both such that a permanent and/or watertight seal is formed between the coupling threads 330 and the drain body 220. In some embodiments, a watertight seal between the coupling threads 330 and the drain body 220 is not necessary, as a flow of water between the coupling threads 330 and the drain body 220 may still flow through the drain coupling 230 and thus through the drain pipe 240.

The drain coupling 230 may further include a plurality of holes (e.g., orifices, openings, etc.) shown as coupling holes 340. The coupling holes 340 extend through the first inner surface 310 and the first outer surface 308 such that the drain coupling 230 is in fluid communication with the overflow channel 140 when the drain coupling 230 is inserted into the drain opening 130. In some embodiments, the drain coupling 230 does not include the coupling holes 340. For example, coupling holes 340 may not be advantageous for use in an alternative wash basin 100 that does not include the overflow channel 140 or a similar overflow channel. Each one of the coupling holes 340 is defined by an annular coupling hole surface 342 that is contiguous with both the first inner surface 310 and the first outer surface 308.

Figure 4B:
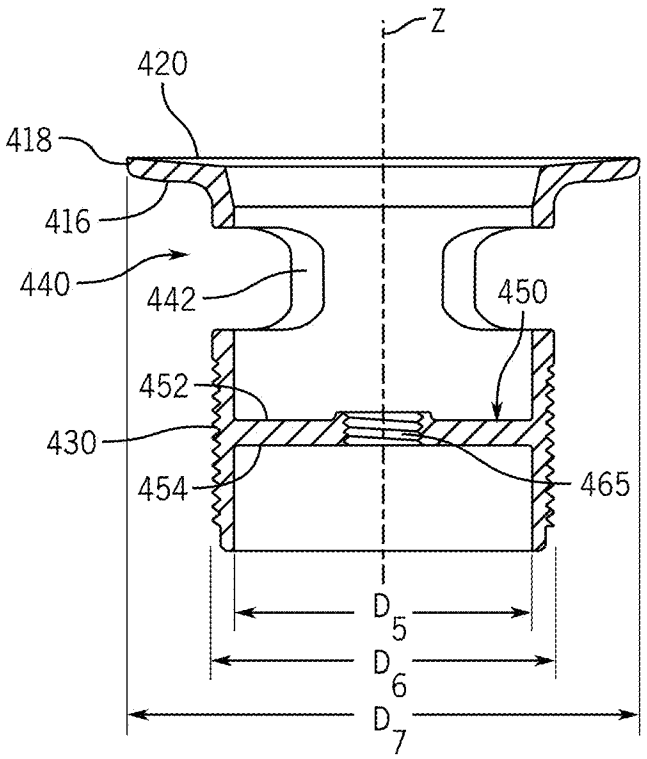
FIG. 4B shows a side, cross-section view of the portion of the blind drain installation assembly of FIG. 4A.
Figure 4A:
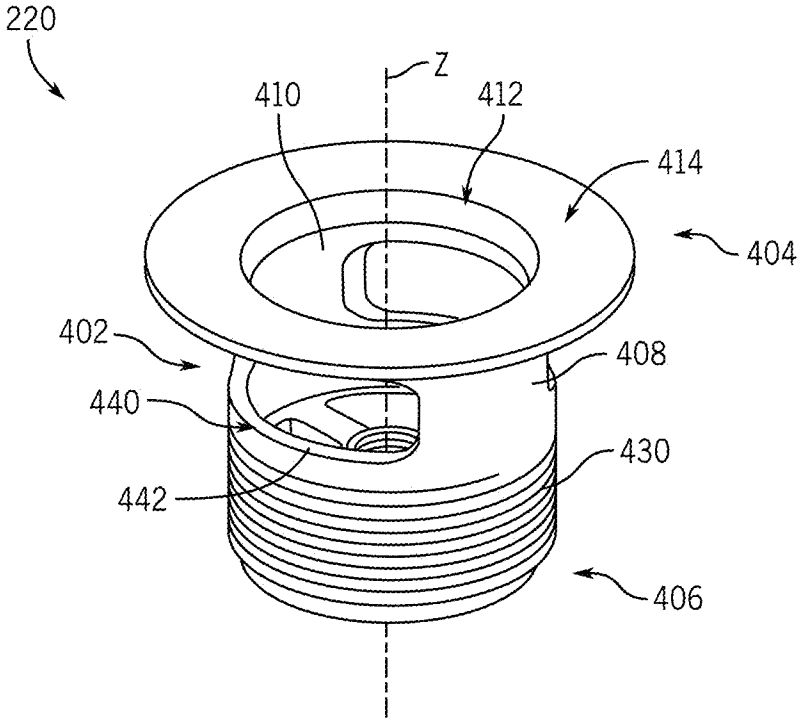
FIG. 4A shows a perspective view of a portion of the blind drain installation assembly of FIG. 2.

Turning to FIGS. 4A and 4B, an exemplary embodiment of the drain body 220 is shown. The drain body 220 includes a generally annular second body 402 having a second upper end 404, a second lower end 406, a second outer surface 408, and a second inner surface 410. The second outer surface 408 and the second inner surface 410 are concentric about the central axis Z. The second inner surface 410 defines a drain body opening 412 having a fifth diameter $D_5$ proximate the second lower end 406. The drain body opening 412 maintains a circular cross-section of the fifth diameter $D_5$ extending between the second upper end 404 and the second lower end 406. The second outer surface 408 maintains a circular cross-section of a sixth diameter $D_6$ extending between the second upper end 404 and the second lower end 406.

The drain body 220 further includes a generally annular second flange 414 extending laterally outwardly from (e.g., orthogonal to) the second outer surface 408. As shown in FIG. 4B, the second flange 414 extends outwardly from the second upper end 404. In some embodiments, the second flange 414 may extend from the second outer surface 408 at other heights such that a portion of the second body 402 extends above the second flange 414 (e.g., between the second flange 414 and the second upper end 404.) The second flange 414 has a seventh diameter $D_7$. The seventh diameter $D_7$ may be generally equal to the fourth diameter $D_4$. The seventh diameter $D_7$ is greater than the drain opening diameter $D_1$.

The second flange 414 includes a second flange first surface 416, a second flange second surface 418, and a second flange third surface 420. The second flange first surface 416 is contiguous with and concentric about the second outer surface 408. In some embodiments, the second flange first surface 416 is perpendicular to the second outer surface 408. In other embodiments, the second flange first surface 416 meets the second outer surface 408 at an angle other than perpendicular. In some embodiments, where the second outer surface 408 and the second flange first surface 416 meet is rounded (e.g., not a sharp corner). This rounded interface between the second outer surface 408 and the second flange first surface 416 may assist in biasing the first flange 314 toward the surfaces defining the drain opening 130 to create a watertight seal between the top basin surface 110, the first flange 314, and the second flange 414.

The second flange first surface 416 is contiguous with the second flange second surface 418. The second flange second surface 418 may be concentric about the central axis Z. The second flange second surface 418 is contiguous with the second flange third surface 420. The second flange third surface 420 may meet the second flange first surface 416 at a corner such that there is no second flange second surface 418. In some embodiments, the second flange second surface 418 is chamfered such that the transition between the second flange first surface 416 and the second flange third surface 420 is smooth (e.g., rounded, uninterrupted, etc.). The second flange third surface 420 is also contiguous with the second inner surface 410. The second flange third surface 420 may be perpendicular to and concentric about the second inner surface 410. In some embodiments, where the second flange third surface 420 and the second inner surface 410 meet may be chamfered such that the transition from the second flange third surface 420 to the second inner surface 410 is uninterrupted by a sharp corner or similar discontinuity (e.g., smooth, rounded, continuous, etc.).

The drain body 220 further includes a generally annular, threaded body, shown as drain body threads 430. The drain body threads 430 interrupt the second outer surface 408 such that a portion of the second outer surface 408 exists between the second upper end 404 and the drain body threads 430. In some embodiments, the drain body threads 430 are disposed proximate the second lower end 406 such that the second outer surface 408 does not exist between the drain body threads 430 and the second lower end 406. In some embodiments, the drain body threads 430 extend between the second upper end 404 and the second lower end 406 such that the second outer surface 408 is entirely covered by the drain body threads 430. As shown in FIG. 4B, the drain body threads 430 extend between the second lower end 406 and approximately half-way between the second upper end 404 and the second lower end 406. The drain body threads 430 may be manufactured from brass, steel, aluminum, plastic, titanium, rubber, or similar materials. The drain body threads 430 may be manufactured into the second outer surface 408 such that the drain body 220 and the drain body threads 430 are a single body (e.g., all one piece, etc.). In some embodiments, the drain body threads 430 are manufactured separately from the drain body 220 and later coupled to the second outer surface 408 by fasteners, interference fit, friction, adhesives, glue, or by similar coupling means. The drain body threads 430 may be concentric about the central axis Z. The drain body threads 430 are configured to threadingly couple to the drain coupling 230 such that a permanent and/or watertight seal is formed between the drain body threads 430 and the coupling threads 330. In some embodiments, a watertight seal between the coupling threads 330 and the drain body threads 430 is not necessary, as a flow of water between the coupling threads 330 and the drain body threads 430 may still flow through the drain coupling 230 and thus through the drain pipe 240. As the drain body 220 is disposed within the drain coupling 230, it may not be necessary, in some embodiments, to create a watertight seal at any interface between the drain body 220 and the drain coupling 230.

The drain body 220 may further include overflow openings 440. The overflow openings interrupt both the second outer surface 408 and the second inner surface 410. The overflow openings 440 may extend through the second outer surface 408 and the second inner surface 410 such that a flow of water may exit the drain body 220 through the overflow openings 440. Each of the overflow openings 440 is defined by a generally rectangular surface, shown as an overflow opening surface 442, contiguous with both the second outer surface 408 and the second inner surface 410.

The drain body 220 further includes a generally annular flange, shown as a second lattice 450, disposed within the second inner surface 410 and extending laterally away from the second inner surface 410, toward the central axis Z. As shown in FIG. 4B, the second lattice 450 may be positioned proximate the second lower end 406. In some embodiments, the second lattice 450 is positioned at a different height such that a portion of the drain body 220 extends between the second lattice 450 and the second lower end 406. The second lattice 450 may be manufactured from metal, plastic, or similar materials. The second lattice 450 may be structurally integrated with the drain body 220, such as is possible though die-casting, injection molding, 3D printing, or similar manufacturing processes. In some embodiments, the second lattice 450 is manufactured separately from the drain body 220 and later coupled to the drain body 220 by welding, fasteners, friction, interference fit, or other coupling means.

The second lattice 450 includes a generally planar top second lattice surface 452 and a generally planar bottom second lattice surface 454. The top second lattice surface 452 and the bottom second lattice surface 454 are both contiguous with the second inner surface 410.

Figure 4C:
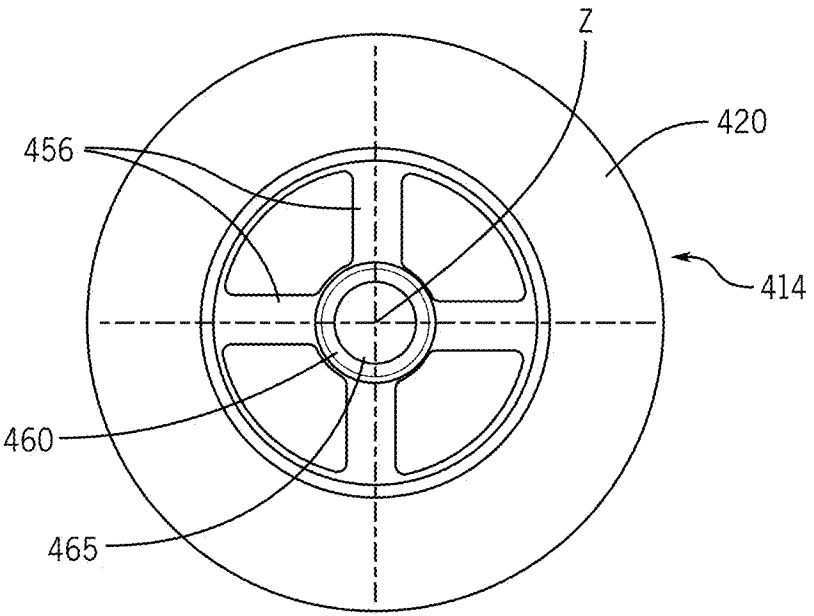
FIG. 4C shows a top view of the portion of the blind drain installation assembly of FIG. 4A.

Extending through both the top second lattice surface 452 and the bottom second lattice surface 454 may be a plurality of openings configured to allow a flow of water to pass through the drain body 220, and likewise the drain coupling 230. As shown in FIG. 4C, the second lattice 450 may include a plurality of support structures 456 configured to extend laterally inward from the second inner surface 410 and toward the central axis Z. The plurality of support structures 456 are configured to allow a flow of water to pass through the drain body 220, such as a flow of water from the wash basin 100.

The plurality of support structures 456 are configured to cooperate proximate the central axis Z to support a generally annular coupling body 460. The coupling body 460 is concentric about the central axis Z. The coupling body 460 includes a coupling body orifice 465 concentric about the central axis Z and configured to accept a fastener, such as may be included in a drain stopper or the toe tap 210. In some embodiments, the coupling body orifice 465 interfaces with the toe tap 210 such that the toe tap 210 may be removably coupled to the drain body 220. In some embodiments, the coupling body orifice 465 is not required during the installation of the toe tap 210, but gives an installer of the blind drain installation assembly 200 options as to which type of stopper or toe tap 210 they may prefer to use.

During installation of the drain body 220 and the drain coupling 230, the coupling threads 330 and the drain body threads 430 are threaded together. This may require an amount of torque greater than can be applied without a tool. The second lattice 450 is configured to interface with a tool (e.g., tub drain wrench, etc.) such that a torque may be applied through the second lattice 450 and to the drain body 220, assisting in threading together the drain coupling 230 and the drain body 220. More specifically, the tool may be configured to interface with the support structures 456 such that rotation of the tool results in the rotation of the drain body 220. The second lattice 450 is configured to withstand high torque loads without failure (e.g., separating from the drain body 220, cracking, bending, deforming, etc.).

Generally speaking, the tool is configured to turn the drain body 220 and tighten the drain body threads 430 to the coupling threads 330 such that coupling threads 330 traverse up the drain body threads 430, toward the bottom basin surface 120. This movement is made possible by the material properties of the drain coupling 230.

Figure 5B:
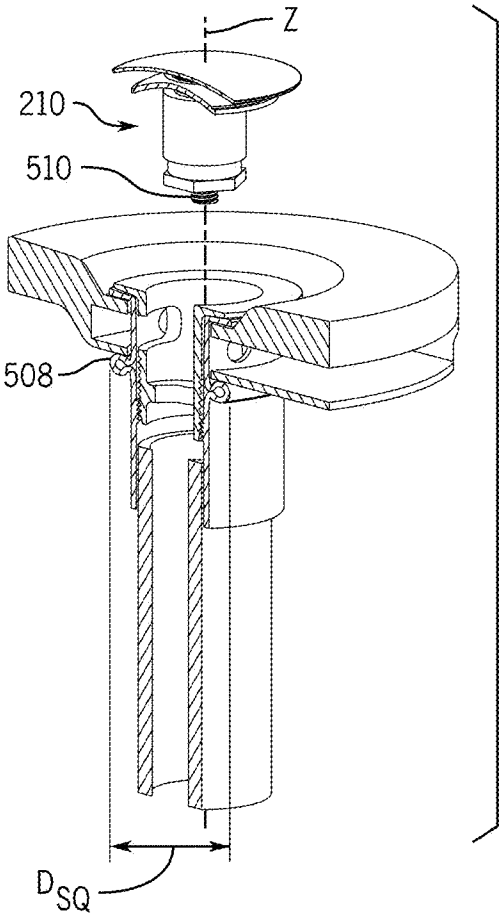
FIG. 5B shows an exploded view of the blind drain installation assembly of FIG. 2 fully installed.
Figure 5A:
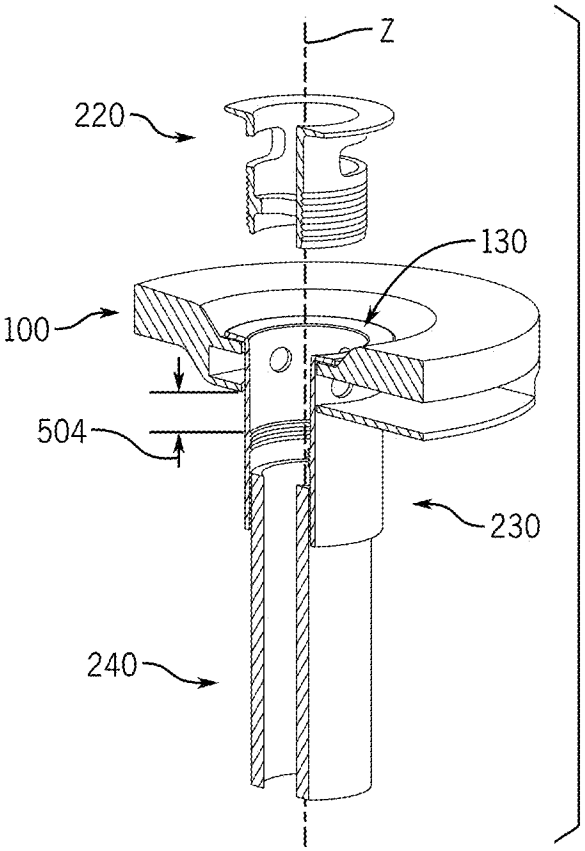
FIG. 5A shows an exploded view of the blind drain installation assembly of FIG. 2 partially installed.
Figure 6:
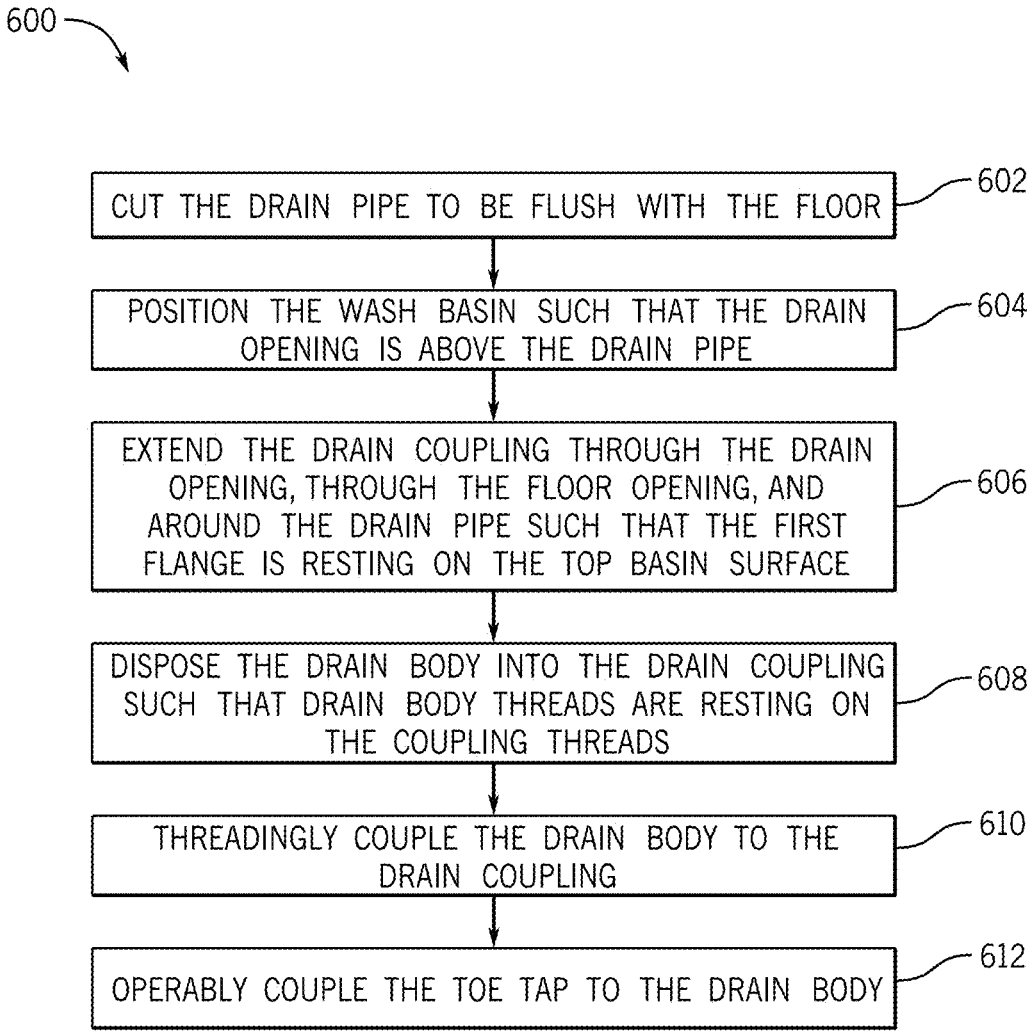
FIG. 6 shows a method of installing the blind drain installation assembly of FIG. 2, according to an exemplary embodiment.

Referring to FIGS. 5A, 5B and 6, an exploded view of a partially installed blind drain installation assembly 200 is shown along with a method 600 for installing the blind drain installation assembly 200. At 602, the drain pipe 240 is cut such that the top drain pipe portion 245 is flush (e.g., even, level, etc.) with the floor 105.

At 604, the wash basin 100 is positioned such that the drain opening 130 is centered over (e.g., concentric about) the drain pipe 240.

At 606, the drain coupling 230 is inserted through the drain opening 130 and around the top drain pipe portion 245 such that the first flange first surface 316 interfaces with the top basin surface 110. In some embodiments, the plurality of annular projections 313 also interface with the drain pipe 240, further aiding in creating a watertight seal. In some embodiments, the watertight seal is a consequence of the compliant (e.g., elastomeric) material used to manufacture the drain coupling 230. The drain coupling 230 is compliant such that the first inner surface 310 may receive a non-cylindrical drain pipe 240. In some embodiments, the drain pipe 240 has an elliptical, hexagonal, octagonal, or otherwise non-circular cross-section. However, due to the compliance of the drain coupling 230, a watertight seal may still be formed between the first inner surface 310 and the drain pipe 240. In some embodiments, it may be desirable to insert the drain coupling 230 within the drain pipe 240.

In some embodiments, where the top drain pipe portion 245 is below the floor 105, it may be the case that the coupling threads 330 are also disposed below the floor 105 during installation. When the drain coupling 230 is first disposed within the drain opening 130, the coupling threads 330 are located below the bottom basin surface 120 and above the top drain pipe portion 245. A portion of the drain coupling 230 is disposed between the coupling threads 330 and the bottom basin surface 120, shown as a compliant portion (e.g., rubber portion, rubber coupling portion, elastomeric portion, etc.) 504.

At 608, the drain body 220 is inserted into the drain coupling 230 such that the drain body threads 430 are resting on the coupling threads 330.

At 610, the drain body 220 is threadingly coupled to the drain coupling 230. In some embodiments, a tool is used to threadingly couple the drain body 220 to the drain coupling 230. When the drain body 220 and the drain coupling 230 are fully seated (e.g., the coupling threads 330 and the drain body threads 430 are tightened to a desired torque), the second flange first surface 416 interfaces with the first flange third surface 320 such that the first flange 314 is squeezed between the second flange 414 and the top basin surface 110, acting as a rubber washer. The squeezing of the first flange 314 creates a watertight seal between the second flange 414 and the top basin surface 110.

When the drain body threads 430 are threaded to the coupling threads 330, the coupling threads 330 translate up, in a direction generally toward the bottom basin surface 120 along the central axis Z. Further, the first lower end 306 slides up the drain pipe 240 toward the bottom basin surface 120 without jeopardizing the watertight seal between the drain coupling 230 and the drain pipe 240. Meanwhile, the first flange 314 does not change position relative to the top basin surface 110. The translational movement of the coupling threads 330 toward the bottom basin surface 120 is allowed because of the compliance of the material used to manufacture the drain coupling 230. The coupling threads 330 squeeze the compliant portion 504 between the coupling threads 330 and the bottom basin surface 120, creating a squeeze bulge 508. The squeeze bulge 508 is configured to interface with the bottom basin surface 120 to secure the drain coupling 230 to the wash basin 100. The squeeze bulge 508 has a squeeze diameter $D_{SQ}$ that is wider than both the drain opening diameter $D_1$ and the third diameter $D_3$. The squeeze bulge 508 cooperates with the compliant portion 504 to hold the drain body 220 within the drain coupling 230, preventing movement of the drain body 220, and likewise the blind drain installation assembly 200, in a direction generally along the central axis Z.

At 612, after the drain body 220 is threaded to the drain coupling 230, the toe tap 210 may be operably coupled to the drain body 220. The toe tap 210 may include a projection, shown as a toe tap fastener 510. The toe tap fastener 510 may be threaded. The toe tap fastener 510 is positioned to be concentric about the central axis Z. The toe tap fastener 510 is configured to be threaded to the coupling body orifice 465. The toe tap 210 is configured to interface with the drain body 220 such that the toe tap 210 can be positioned to selectively prevent a flow of water from flowing through the drain body 220, and likewise preventing a flow of water from flowing through the drain pipe 240. The toe tap 210 may be configured to be positioned to control a flow rate of a flow of water through the drain pipe 240. The toe tap 210 is also configured to prevent large foreign objects (e.g., rings, marbles, hair, soot, pills, etc.) from passing through the drain body 220 while still allowing water to flow through. In some embodiments, the toe tap 210 is configured to only allow water and other liquids with similar properties (e.g., drain cleaner, liquid soap, etc.) to pass through the drain body 220, and likewise the drain pipe 240.

Figure 7:
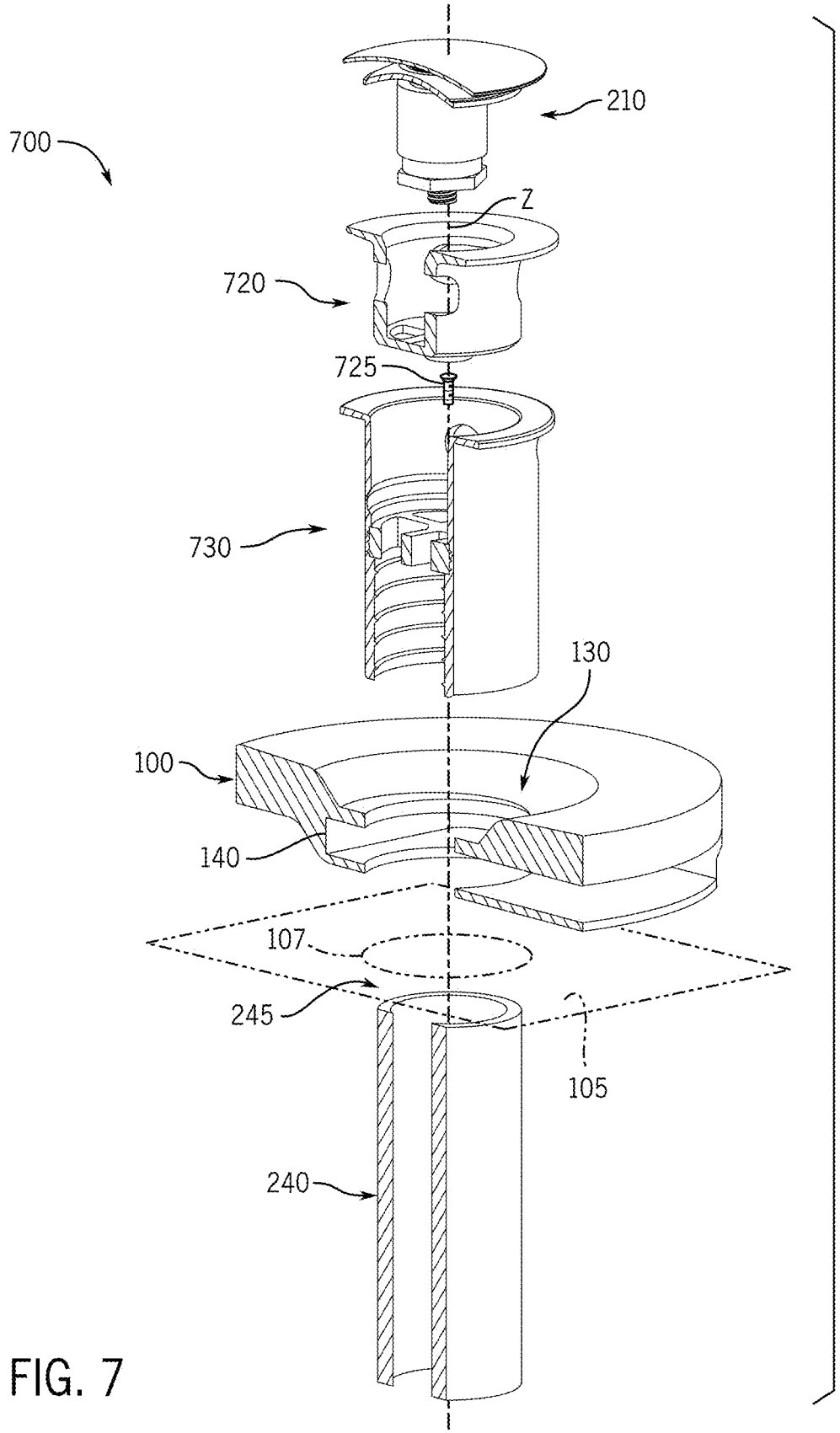
FIG. 7 shows an exploded view of a blind drain installation assembly according to another example embodiment.

Turning now to FIG. 7, a blind drain installation assembly 700 is shown, according to an example embodiment. The blind drain installation assembly 700 includes a drain body 720, a fastener 725, and a drain coupling 730. In some embodiments, the blind drain installation assembly also includes the toe tap 210. The blind drain installation assembly 700 is similar to the blind drain installation assembly 200. A difference between the blind drain installation assembly 200 and the blind drain installation assembly 700 is that the blind drain installation assembly 700 uses the fastener 725 to couple the drain body 720 to the drain coupling 730.

Figure 8B:
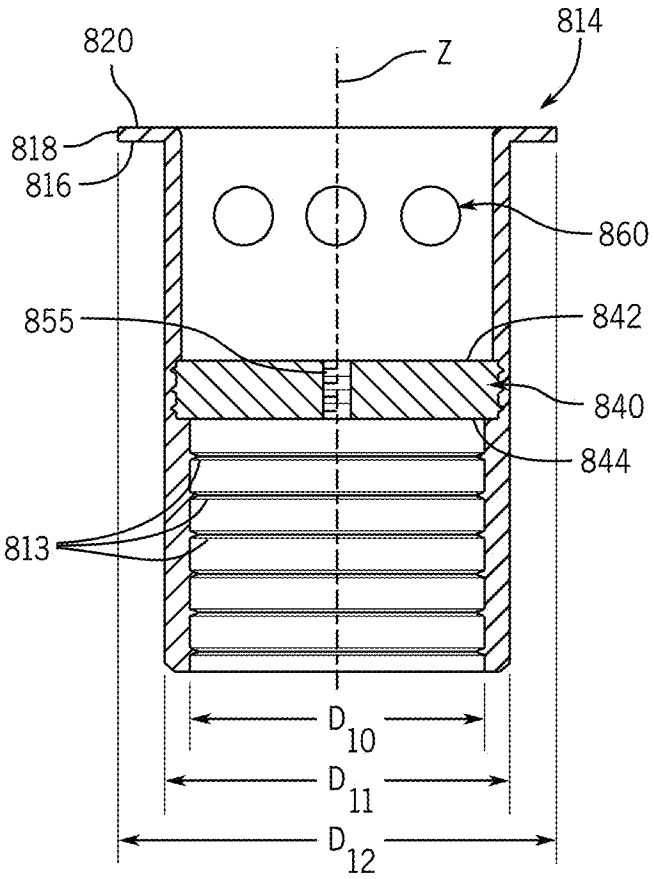
FIG. 8B shows a side, cross-section view of the portion of the blind drain installation assembly of FIG. 8A.
Figure 8A:
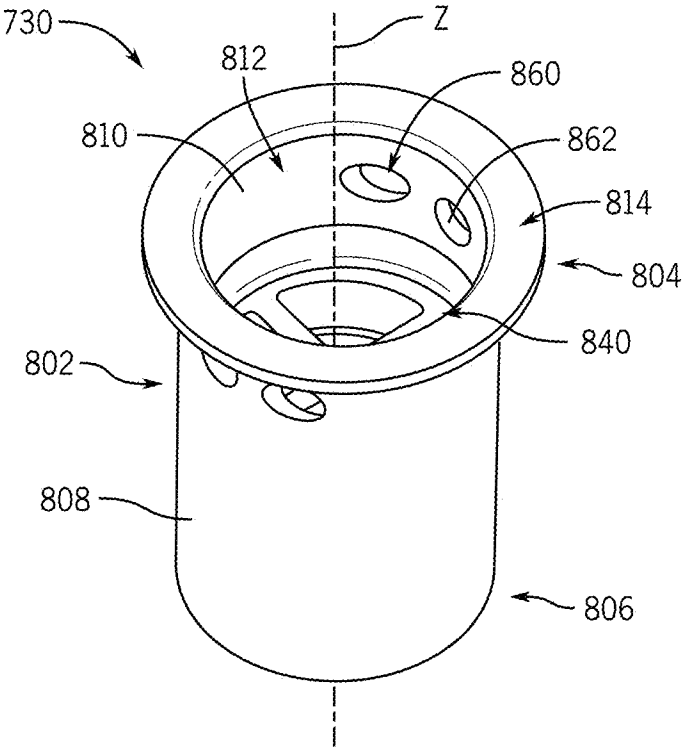
FIG. 8A shows a perspective view of a portion of the blind drain installation assembly of FIG. 7.

Referring to FIG. 8A, the drain coupling 730 is shown. The drain coupling 730 is similar to the drain coupling 230. A difference between the drain coupling 730 and the drain coupling 230 is that the drain coupling 730 includes an annular flange, shown as a first lattice 840, configured to cooperate with the fastener 725 and the drain body 720 to couple the drain body 720 to the drain coupling 730.

The drain coupling 730 includes a generally annular first body 802 having a first upper end 804, a first lower end 806, a first outer surface 808, and a first inner surface 810. The first outer surface 808 and the first inner surface 810 may be concentric about the central axis Z. The first inner surface 810 defines an orifice (e.g., a flow path, etc.), shown as a coupling opening 812 configured to accept the drain pipe 240 and the drain body 720. The first inner surface 810 is configured to interface with the drain pipe 240 to provide a sealant such that a water-tight seal is formed between the drain coupling 730 and the drain pipe 240. The drain coupling 730 may include a plurality of annular projections 813 extending laterally away from the first inner surface 810 and toward the central axis Z. As shown in FIG. 8B, the plurality of annular projections 813 are disposed between the first lower end 806 and approximately half-way between the first lower end 806 and the first upper end 804. The plurality of annular projections 813 may be integrally manufactured to the drain coupling 730. In some embodiments, the plurality of annular projections 813 are manufactured separately and later coupled to the drain coupling 730. The drain coupling 730 may be formed from a compressible material (e.g., neoprene, rubber, elastomer, etc.) or other suitable material configured to provide sealing engagement between the first inner surface 810 and the drain pipe 240. In some embodiments, the drain coupling 730 may be coupled to the drain pipe 240 such that the drain coupling 730 stays in place relative to the drain pipe 240 as the wash basin 100 is moved around relative to the drain pipe 240.

Figure 8C:
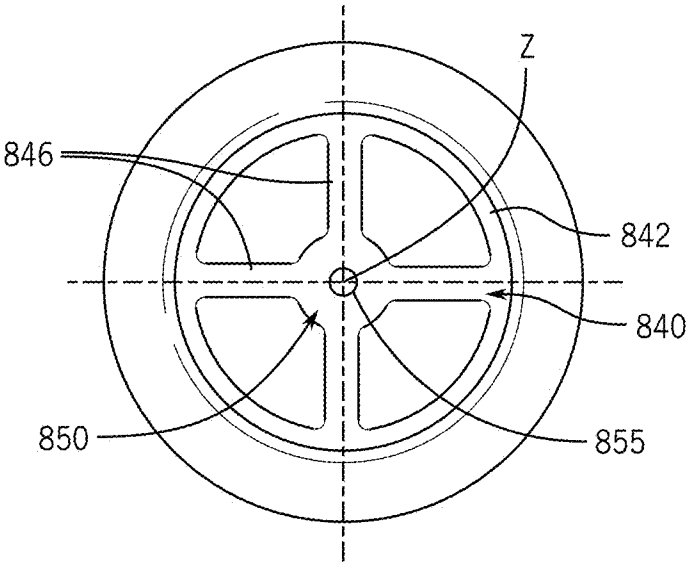
FIG. 8C shows a top view of the portion of the blind drain installation assembly of FIG. 8A.

Proximate the first lower end 806, the first inner surface 810 has a tenth diameter $D_{10}$. The first inner surface 810 may maintain a circular cross-section of the tenth diameter $D_{10}$ extending from the first lower end 806 to the first upper end 804. In some embodiments, the diameter of the first inner surface 810 proximate the first upper end 804 is different (e.g., greater, lesser, etc.) than the tenth diameter $D_{10}$. The first inner surface 810 is configured to accept the drain body 720. The first inner surface 810 is also configured to allow a flow of water to pass through. FIG. 8C shows a generally circular coupling opening 812, although according to other embodiments, the coupling opening 812 may be elliptical, hexagonal, octagonal, or otherwise similar to the shape of the drain pipe 240. Proximate the first lower end 806, the first outer surface 808 has an eleventh diameter $D_{11}$. The first outer surface 808 maintains a circular cross-section of the eleventh diameter $D_{11}$ extending from the first lower end 806 to the first upper end 804. In some embodiments, the first outer surface 808 proximate the first lower end 806 and the first upper end 804 has different diameters. The eleventh diameter $D_{11}$ is smaller than both the drain opening diameter $D_1$ and the floor opening diameter $D_0$.

A generally annular first flange 814 extends laterally outwardly from (e.g., orthogonally to) the first outer surface 808. As shown in FIG. 8B, the first flange 814 extends from the first upper end 804 of the first body 802. In some embodiments, the first flange 814 may extend outwardly from the first outer surface 808 at other heights such that at least a portion of the first body 802 extends above the first flange 814 (e.g., between the first flange 814 and the first upper end 804). The first flange 814 has a twelfth diameter $D_{12}$. The twelfth diameter $D_{12}$ is greater than the drain opening diameter $D_1$. The first flange 814 is configured to interface with the top basin surface 110 to form a watertight seal such that a flow of water is not able to exist between the top basin surface 110 and the first flange 814.

The first flange 814 includes a first flange first surface 816, a first flange second surface 818, and a first flange third surface 820. The first flange first surface 816 is disposed at an underside of the first flange 814 and is configured to cooperate and interface with the top basin surface 110 such that a water-tight seal is created between the first flange 814 and the top basin surface 110. The first flange first surface 816 extends laterally outwardly from and is generally perpendicular to and contiguous with the first outer surface 808. In some embodiments, the first flange first surface 816 projects outwardly from the first outer surface 808 at an angle that is not perpendicular. The first flange second surface 818 is contiguous with the first flange first surface 816. The first flange second surface 818 may be concentric about the center axis Z and may have the twelfth diameter $D_{12}$. The first flange second surface 818 may be parallel with the first outer surface 808. The first flange third surface 820 is contiguous with the first flange second surface 818 and may be parallel to the first flange first surface 816. The first flange third surface 820 is disposed proximate the first upper end 804. The first flange third surface 820 is configured to interface with a portion of the drain body 720 to create a watertight seal between the drain coupling 730 and the drain body 720 such that a flow of water is prevented from flowing between the first flange third surface 820 and the drain body 720. The first flange third surface 820 is contiguous with the first inner surface 810. The first flange third surface 820 and the first inner surface 810 may meet at a corner. In some embodiments, the corner is chamfered (e.g., filleted, rounded, blunted, etc.) such that the transition between the first flange third surface 820 and the first inner surface 810 is uninterrupted (e.g., smooth, rounded, etc.).

The drain coupling 730 further includes a generally annular flange, shown as a first lattice 840. The first lattice 840 is similar to the coupling threads 330. A difference between the first lattice 840 and the coupling threads 330 is that the first lattice 840 is configured to accept the fastener 725. The first lattice 840 extends orthogonally away from the first inner surface 810 and is disposed approximately half-way between the first lower end 806 and the first upper end 804. In some embodiments, the plurality of annular projections 813 are disposed between the first lattice 840 and the first lower end 806. The first lattice 840 may be manufactured from brass, steel, aluminum, plastic, titanium, rubber, or similar materials. The first lattice 840 may be manufactured into the first inner surface 810 such that the drain coupling 730 and the first lattice 840 are a single body (e.g., all one piece, etc.). In some embodiments, the first lattice 840 is manufactured separately from the drain coupling 730 and later coupled to the drain coupling 730 by over-molding, fasteners, interference fit, friction, adhesives, glue, or by similar coupling means.

The first lattice 840 includes a generally planar top first lattice surface 842 and a generally planar bottom first lattice surface 844. Extending through both the top first lattice surface 842 and the bottom first lattice surface 844 may be a plurality of holes configured to allow a flow of water to pass through the drain coupling 730. As shown in FIG. 8C, the first lattice 840 may include a plurality of support structures 846 that extend laterally away from the first inner surface 810 and toward the central axis Z. The plurality of support structures 846 are configured to allow a flow of water to pass through the drain coupling 730. The plurality of support structures 846 cooperate proximate the central axis Z to form a first coupling body 850. The first coupling body 850 includes a first orifice 855 concentric about the central axis Z and configured to receive the fastener 725. During the installation of the blind drain installation assembly 700, the fastener will extend through the drain body 720 and threadingly couple to the drain coupling 730 via the first orifice 855. Prior to threading the fastener 725 into the first orifice 855, an adhesive (e.g., thread sealant, thread bond, thread lock, etc.) may be applied to the fastener 725.

The drain coupling 730 may further include a plurality of holes (e.g., orifices, openings, etc.) shown as coupling holes 860. The coupling holes 860 extend through the first inner surface 810 and the first outer surface 808 such that the drain coupling 730 is in fluid communication with the overflow channel 140 when the drain coupling 730 is installed in the drain opening 130. Each one of the coupling holes 860 is defined by an annular coupling hole surface 862 that is contiguous with both the first inner surface 810 and the first outer surface 808. In some embodiments, the drain coupling 730 does not include the coupling holes 860. For example, coupling holes 860 may not be advantageous for use in an alternative wash basin 100 that does not include the overflow channel 140 or a similar overflow channel.

Figure 9B:
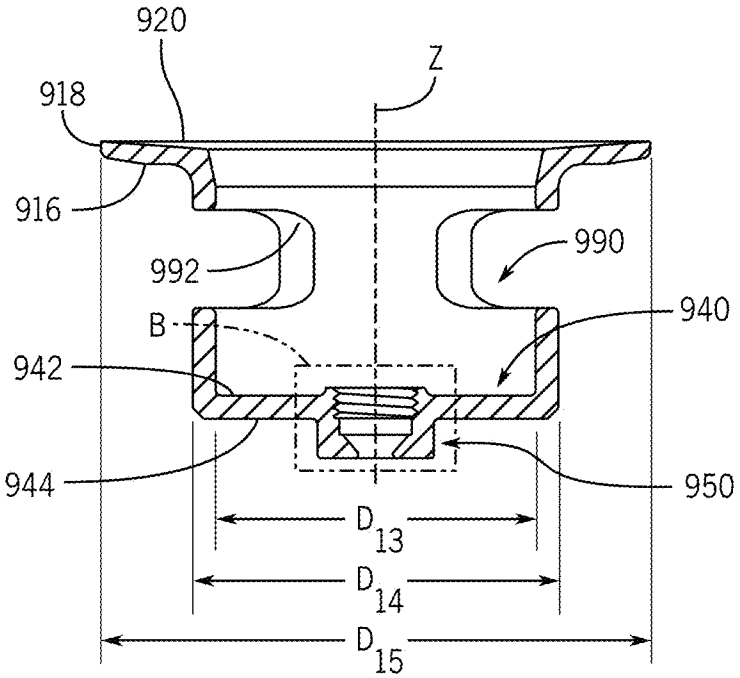
FIG. 9B shows a side, cross-section view of the portion of the blind drain installation assembly of FIG. 9A.
Figure 9A:
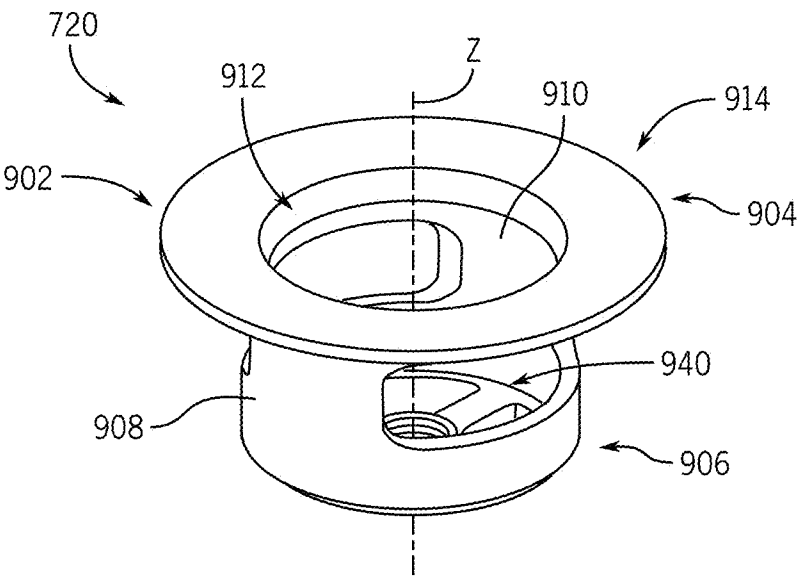
FIG. 9A shows a perspective view of a portion of the blind drain installation assembly of FIG. 7.

Turning to FIG. 9A, the drain body 720 is shown according to an example embodiment. The drain body 720 is similar to the drain body 220. A difference between the drain body 720 and the drain body 220 is that the drain body 720 is coupled to the drain coupling 730 using a fastener, such as the fastener 725.

The drain body 720 includes a generally annular second body 902 having a second upper end 904, a second lower end 906, a second outer surface 908, and a second inner surface 910. The second outer surface 908 and the second inner surface 910 are concentric about the central axis Z. The second inner surface 910 defines a drain body opening 912 having a thirteenth diameter $D_{13}$ proximate the second lower end 906. The drain body opening 912 maintains a circular cross-section of the thirteenth diameter $D_{13}$ extending between the second upper end 904 and the second lower end 906. The second outer surface 908 maintains a circular cross-section of a fourteenth diameter $D_{14}$ extending between the second upper end 904 and the second lower end 906. The fourteenth diameter $D_{14}$ is less than the tenth diameter $D_{10}$.

The drain body 720 further includes a generally annular second flange 914 extending laterally outwardly from (e.g., orthogonal to) the second outer surface 908. As shown in FIG. 9B, the second flange 914 extends outwardly from the second upper end 904. In some embodiments, the second flange 914 may extend from the second outer surface 908 at other heights such that a portion of the second body 902 extends above the second flange 914 (e.g., between the second flange 914 and the second upper end 904.) The second flange 914 has a fifteenth diameter $D_{15}$. The fifteenth diameter $D_{15}$ may be generally equal to the twelfth diameter $D_{12}$. The fifteenth diameter $D_{15}$ is greater the drain opening diameter $D_1$.

The second flange 914 includes a second flange first surface 916, a second flange second surface 918, and a second flange third surface 920. The second flange first surface 916 is contiguous with and concentric about the second outer surface 908. In some embodiments, the second flange first surface 916 is perpendicular to the second outer surface 908. In other embodiments, the second flange first surface 916 meets the second outer surface 908 at an angle other than perpendicular. In some embodiments, the transition from second flange first surface 916 to the second outer surface 908 is rounded. This rounded interface between the second outer surface 908 and the second flange first surface 916 may assist in biasing the first flange 814 toward the surfaces defining the drain opening 130 to create a watertight seal between the top basin surface 110, the first flange 814, and the second flange 914.

The second flange first surface 916 is contiguous with the second flange second surface 918. The second flange second surface 918 may be concentric about the central axis Z. The second flange second surface 918 is contiguous with the second flange third surface 920. The second flange third surface 920 may meet the second flange first surface 916 at a corner such that there is no second flange second surface 918. In some embodiments, the second flange second surface 918 is chamfered such that the transition between the second flange first surface 916 and the second flange third surface 920 is smooth (e.g., rounded, uninterrupted, etc.). The second flange third surface 920 is also contiguous with the second inner surface 910. The second flange third surface 920 may be perpendicular to and concentric about the second inner surface 910. In some embodiments, where the second flange third surface 920 and the second inner surface 910 meet may be chamfered such that the transition from the second flange third surface 920 to the second inner surface 910 is uninterrupted by a sharp corner or similar discontinuity (e.g., smooth, rounded, continuous, etc.).

The drain body 720 further includes a generally annular flange, shown as a second lattice 940. The second lattice 940 extends laterally away from the second inner surface 910 and toward the central axis Z. As shown in FIG. 9B, the second lattice 940 extends inwardly from the second lower end 906. In some embodiments, the second lattice 940 is disposed at a different height, such that a portion of the second inner surface 910 is disposed between the second lattice 940 and the second lower end 906. The second lattice 940 includes a generally planar top second lattice surface 942 and a generally planar bottom second lattice surface 944. The top second lattice surface 942 is contiguous with the second inner surface 910, and the bottom second lattice surface 944 is contiguous with the second outer surface 908.

Extending through both the top second lattice surface 942 and the bottom second lattice surface 944 may be a plurality of openings configured to allow a flow of water to pass through the drain body 720, and likewise the drain coupling 730. As shown in FIG. 9C, the second lattice 940 may include a plurality of support structures 946 configured to extend laterally inward from the second inner surface 910 and toward the central axis Z. The plurality of support structures 946 are configured to allow a flow of water to pass through the drain body 720, such as a flow of water from the wash basin 100.

The plurality of support structures 946 is configured to cooperate proximate the central axis Z to support a generally annular second coupling body 950, shown in portion B of FIG. 9B. The second coupling body 950 is concentric about the central axis Z. The second coupling body 950 is configured to interface with the first lattice 840 when the drain body 720 and the drain coupling 730 are coupled together, acting as a spacer. In some embodiments, the second coupling body 950 extends into the first lattice 840, helping to align the second coupling body 950 concentrically about the first orifice 855. In some embodiments, the second coupling body 950 has a non-circular cross-section (e.g., square, ellipse, hexagonal, etc.) configured to extend into the first lattice 840 and prevent rotation of the drain body 720 relative to the drain coupling 730 about the central axis Z during installation (e.g., tightening of the fastener 725).

Figure 9D:
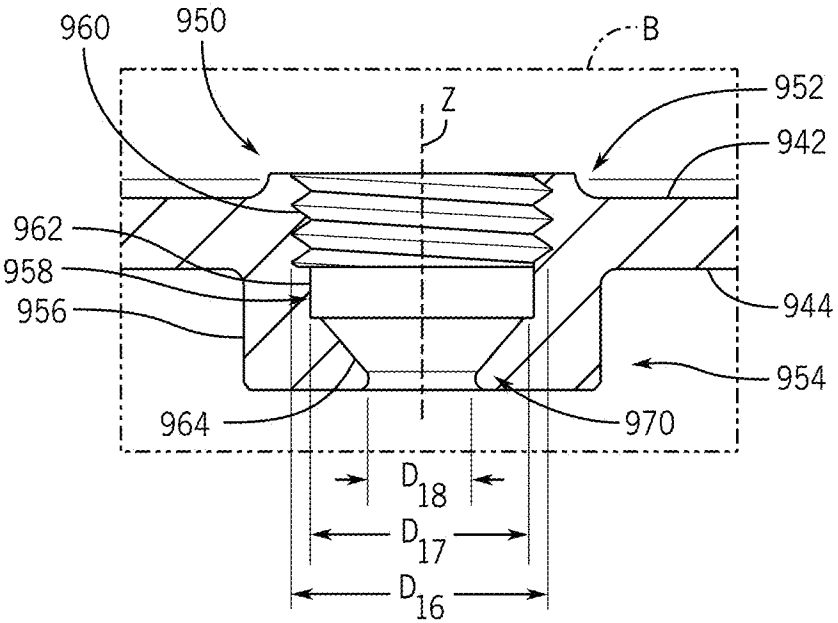
FIG. 9D shows a zoomed-in view of the portion B of FIG. 9B.
Figure 9C:
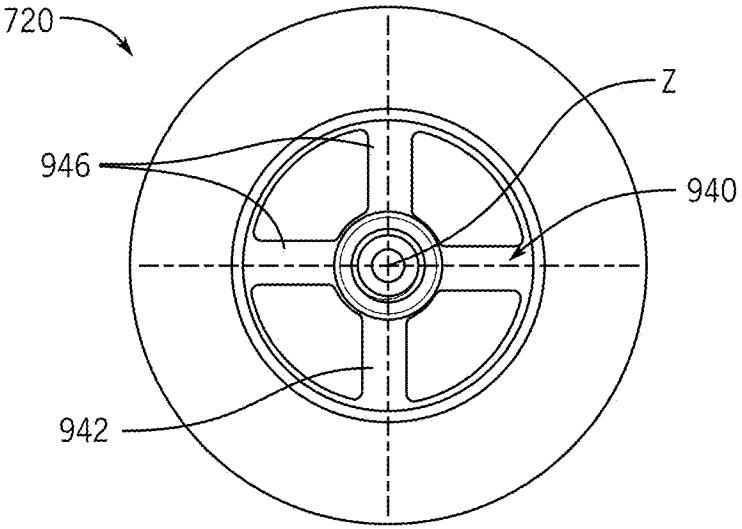
FIG. 9C shows a top view of the portion of the blind drain installation assembly of FIG. 9A.

Referring to FIG. 9D, a zoomed-in view of the portion B of FIG. 9B. The second coupling body 950 includes an third upper end 952, a third lower end 954, a third outer surface 956, and a third inner surface 958. As shown, the third lower end 954 extends below the bottom second lattice surface 944. In some embodiments, the third lower end 954 is flush with the bottom second lattice surface 944. In other embodiments, the third lower end 954 is disposed above the bottom second lattice surface 944 such that the third lower end 954 is depressed within the second lattice 940 at a height above the bottom second lattice surface 944. In embodiments, such as embodiments where the second lattice 940 is disposed at a height above the second lower end 906 such that a portion of the second inner surface 910 is disposed between the second lower end 906 and the second lattice 940, the third lower end 954 may extend below the bottom second lattice surface 944, but above the second lower end 906.

The third upper end 952 may extend above the top second lattice surface 942 such that the third upper end 952 creates a projection (e.g., bump, etc.) on the second lattice 940. In some embodiments, the third upper end 952 is flush with top second lattice surface 942 such that there is no depression or bump. In some embodiments, the third upper end 952 may be disposed below the top second lattice surface 942 such that a depression is made in the second lattice 940.

The second coupling body 950 further includes an annular orifice concentric about the central axis Z that is defined by the third inner surface 958. The third inner surface 958 includes a third inner first portion 960 and a third inner second portion 962. The third inner first portion 960 is threaded to accept a threaded body, such as a fastener, preferably the toe tap fastener 510. The third inner first portion 960 defines a sixteenth diameter $D_{16}$. When the toe tap fastener 510 is threadingly coupled to the third inner first portion 960 of the second coupling body 950, the toe tap fastener 510 rests flush with a bottom of the third inner first portion 960 (e.g., flush with a top of the third inner second portion 962). In some embodiments, when the toe tap fastener 510 is threadingly coupled to the second coupling body 950, a portion of the toe tap fastener 510 extends below the third inner first portion 960 and into the cavity defined by the third inner second portion 962.

Contiguous with the third inner first portion 960 is the third inner second portion 962, concentric about the central axis Z and defining a seventeenth diameter $D_{17}$. The seventeenth diameter $D_{17}$ is smaller than (e.g., less than, etc.) than the sixteenth diameter $D_{16}$. The change in diameter between the third inner first portion 960 and the third inner second portion 962 aids in preventing the toe tap fastener 510 (e.g., any fastener with threads matching the pitch of the third inner first portion 960) from threading or extending into the third inner second portion 962.

Figure 9E:
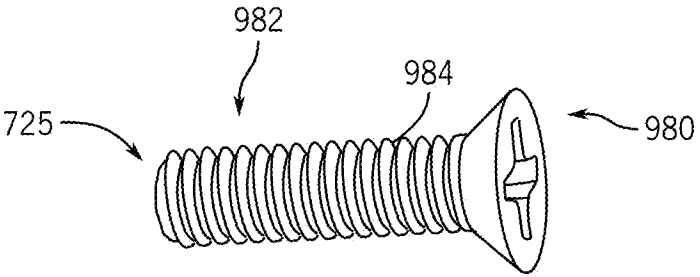
FIG. 9E shows a perspective view of a portion of the blind drain installation assembly of FIG. 7.

Proximate the third lower end 954 and disposed within the third inner second portion 962 is a generally annular flange, shown as a third flange 970. The third flange 970 extends laterally away from the third inner surface 958 and inwardly toward the central axis Z. As shown in FIG. 9D, the third flange 970 extends inwardly from the third lower end 954. In some embodiments, the third flange 970 is disposed at a different height, such that a portion of the third inner surface 958 is disposed between the third lower end 954 and the third flange 970. The third flange 970 defines an eighteenth diameter $D_{18}$. The eighteenth diameter $D_{18}$ is smaller than the seventeenth diameter $D_{17}$. The third flange 970 and the third inner second portion 962 cooperate to accept a fastener head, such as a head of the fastener 725. As shown in FIG. 9E, the fastener 725 includes a fastener head 980, a fastener shank 982, and fastener threads 984. The fastener head 980 has a diameter greater than the eighteenth diameter $D_{18}$ such that the fastener head 980 rests on the third flange 970 and does not fall through the second coupling body 950 during installation and use. The fastener shank 982 may interface with the third flange 970. As shown in FIG. 9D, the third flange 970 is tapered toward the central axis Z, shown as a taper 964, giving the third flange 970 a frustoconical shape, changing from the seventeenth diameter $D_{17}$ nearer the third inner second portion 962 to the eighteenth diameter $D_{18}$ proximate the third lower end 954. In some embodiments, the third flange 970 is not tapered, but instead has a flat top surface extending perpendicularly away from the third inner surface 958 of the third inner second portion 962. In such an embodiment, it may be preferable to use a fastener with a button head or pan head. Generally, the third flange 970 is configured to accept the head of a fastener and position the head of the fastener below the third inner first portion 960 and within the third inner second portion 962.

The drain body 720 may further include overflow openings 990. The overflow openings 990 may extend through the second outer surface 908 and the second inner surface 910 such that a flow of water may exit the drain body 720 through the overflow openings 990. The overflow openings 990 are positioned at a height relative to the second flange 914 such that the overflow openings 990 are in fluid communication with the coupling holes 860 when the blind drain installation assembly 700 is installed. Each one of the overflow openings 990 is defined by an annular coupling hole surface 992 that is contiguous with both the second inner surface 910 and the second outer surface 908.

Figures 10A, 10B:
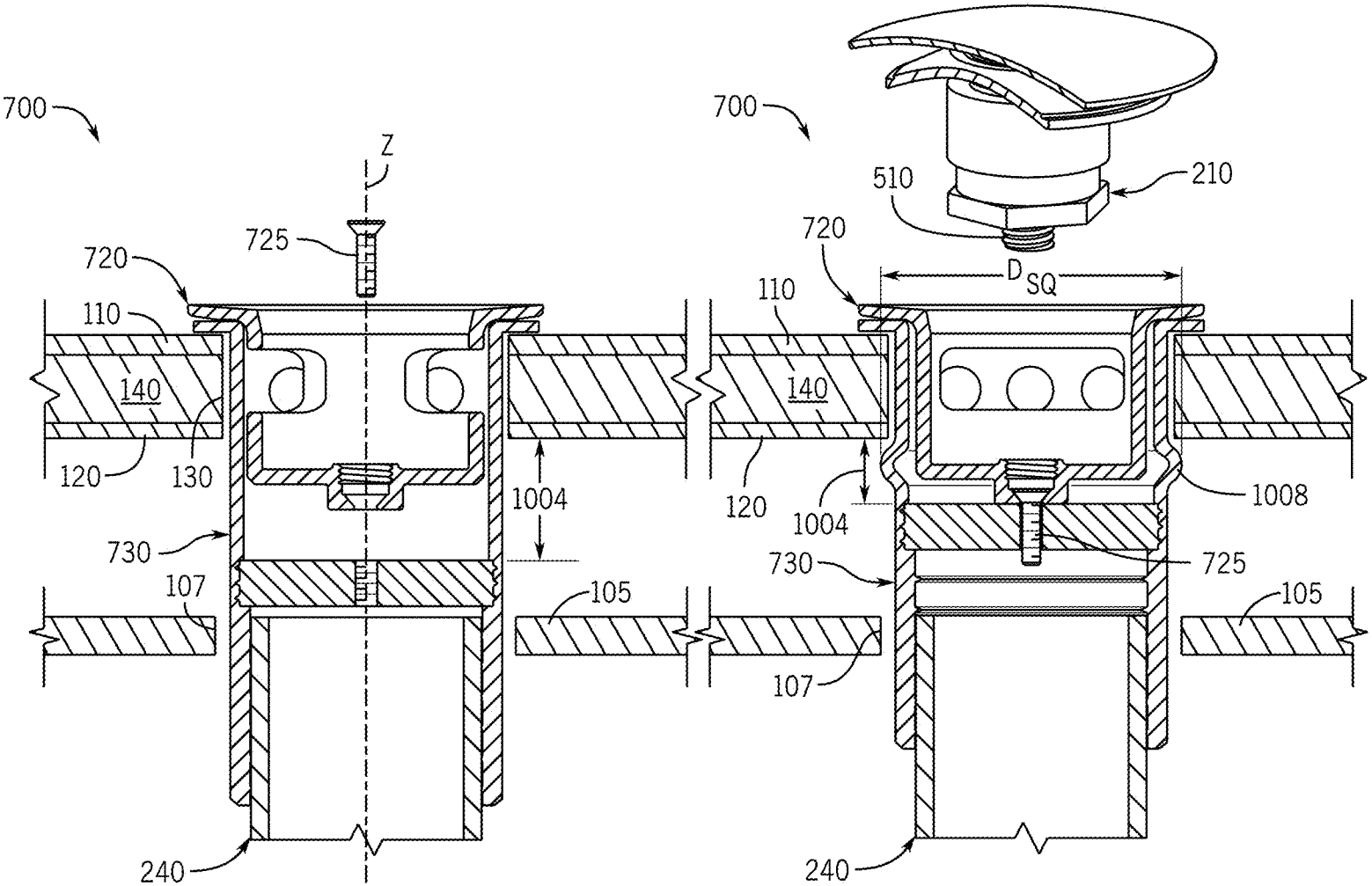
FIG. 10A shows an exploded side, cross-sectional view of the blind drain installation assembly of FIG. 7 partially installed.
FIG. 10B shows an exploded side, cross-sectional view of the blind drain installation assembly of FIG. 7 fully installed.
Figure 11:
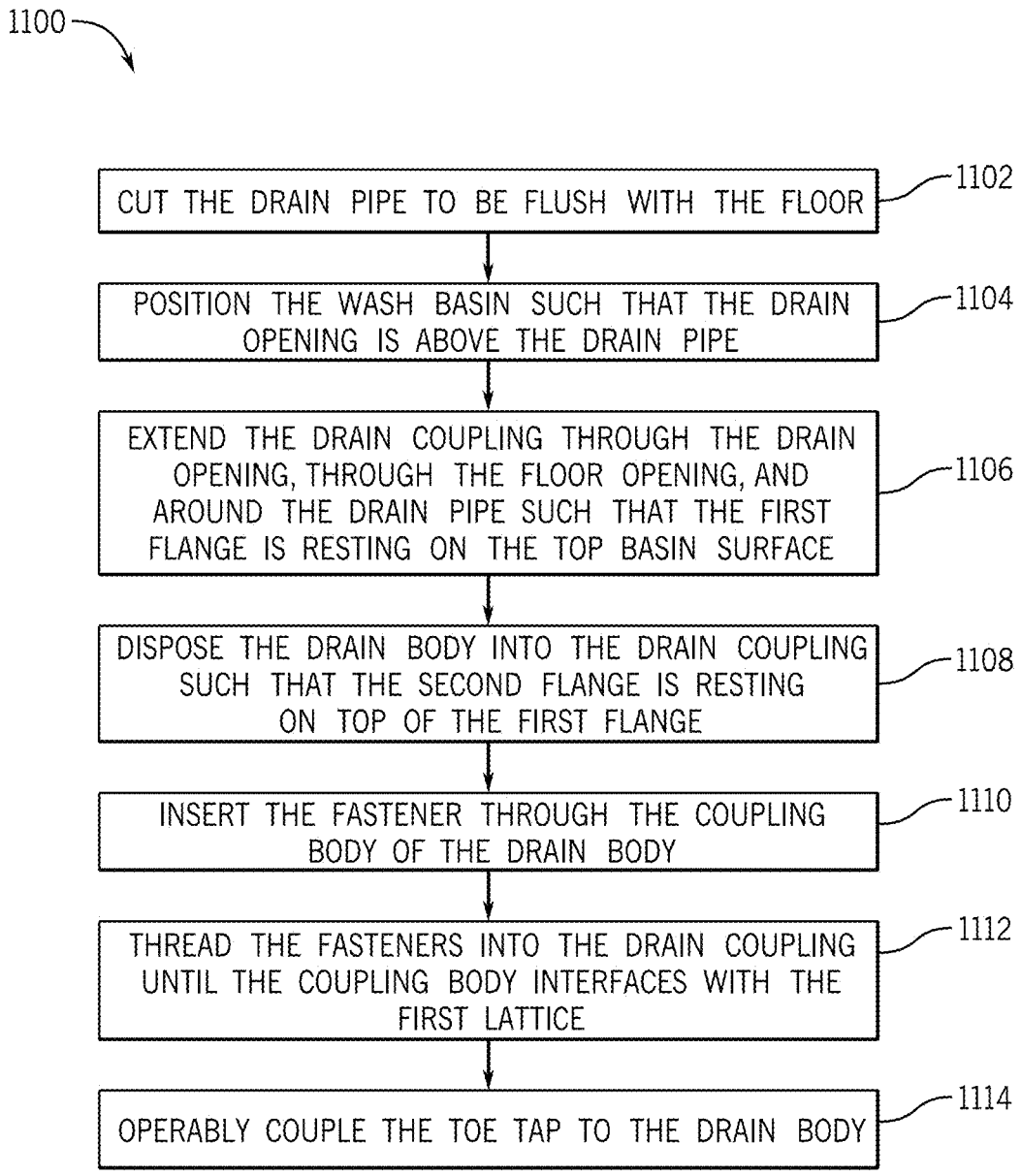
FIG. 11 shows a method of installing the blind drain installation assembly of FIG. 7, according to an exemplary embodiment.

Turning to FIGS. 10A, 10B, and 11, an exploded view of the installation process of the blind drain installation assembly 700 is shown along with a method 1100 of installing the blind drain installation assembly 700. The method 1100 is similar to the method 600. A difference between the two methods is that in method 1100, the drain body 720 is coupled to the drain coupling 730 using a fastener, such as the fastener 725.

To begin installation, at 1102, the drain pipe 240 that extends through the floor opening 107 is cut such that the top drain pipe portion 245 is flush with the top of the floor 105. At 1104, the wash basin 100 is then positioned on the floor 105 and above the drain pipe 240 such that the drain pipe 240 and the drain opening 130 are lined up (e.g., concentric about each other).

At 1106, the drain coupling 730 is extended through the drain opening 130 and positioned around the drain pipe 240. The drain coupling 730 extends through the floor opening 107 and below the floor 105. The first lattice 840 is positioned between the drain opening 130 and the top drain pipe portion 245. In some embodiments, the top drain pipe portion 245 may be disposed below the floor 105. In such embodiments, the first lattice 840 may be positioned below the floor 105. The first flange 814 rests on the top basin surface 110 such that the drain coupling 730 does not fall through the drain opening 130.

At 1108, the drain body 720 is disposed within the drain coupling 730 such that the second flange 914 rests on top of the first flange 814. Further, the second coupling body 950 is positioned to be concentric about the first orifice 855. In some embodiments, the second coupling body 950 extends into the first lattice 840 to aid in the alignment of the second coupling body 950 with the first orifice 855. In some embodiments, the second coupling body 950 has a non-circular cross-section (e.g., square, ellipse, hexagonal, etc.) and extends into the first lattice 840 such that the rotation of the drain body 720 is prevented relative to the drain coupling 730 during installation.

At 1110, the fastener 725 is inserted through the second coupling body 950. At 1112, the fastener 725 is threadingly coupled to the first orifice 855. As shown in FIGS. 10A and 10B, during the threading of the fastener 725, the first lattice 840 traverses up the fastener threads 984 along the central axis Z. The first lower end 806 also slides up the drain pipe 240 and toward the bottom basin surface 120 without jeopardizing the watertight seal between the drain coupling 730 and the drain pipe 240. This translational motion along the central axis Z is also a result of the malleability of the drain coupling 730. When the fastener 725 is fully threaded (e.g., torqued, seated, tight, etc.), a portion 1004 (e.g., squeeze portion) of the drain coupling 730 between the first lattice 840 and the bottom basin surface 120 is deformed, creating a generally annular squeeze bulge 1008 with a squeeze diameter $D_{SQ}$. The squeeze diameter $D_{SQ}$ is larger than the drain opening diameter $D_1$ to prevent translational movement of the blind drain installation assembly 700 relative to the drain pipe 240 along the central axis Z. In some embodiments, the side walls of the drain coupling 730 at the portion 1004 are thinned out to facilitate formation of the squeeze bulge 1008.

As shown in FIG. 10B, the fastener 725 is fully seated when the second coupling body 950 interfaces with the first lattice 840. In some embodiments, a spring washer may be disposed between the second coupling body 950 and the first lattice 840 to prevent backing out of the fastener 725. In other embodiments, the elasticity of the squeeze bulge 1008 provides enough tension to prevent the fastener 725 from loosening. In some embodiments, the toe tap fastener 510 prevents the fastener 725 from backing out, similar to how a lock nut behaves.

At 1114, the toe tap 210 is operably coupled to the drain body 720. In some embodiments, the toe tap includes the toe tap fastener 510, configured to threading couple to the third inner first portion 960 of the second coupling body 950 of the drain body 720.

Figure 12:
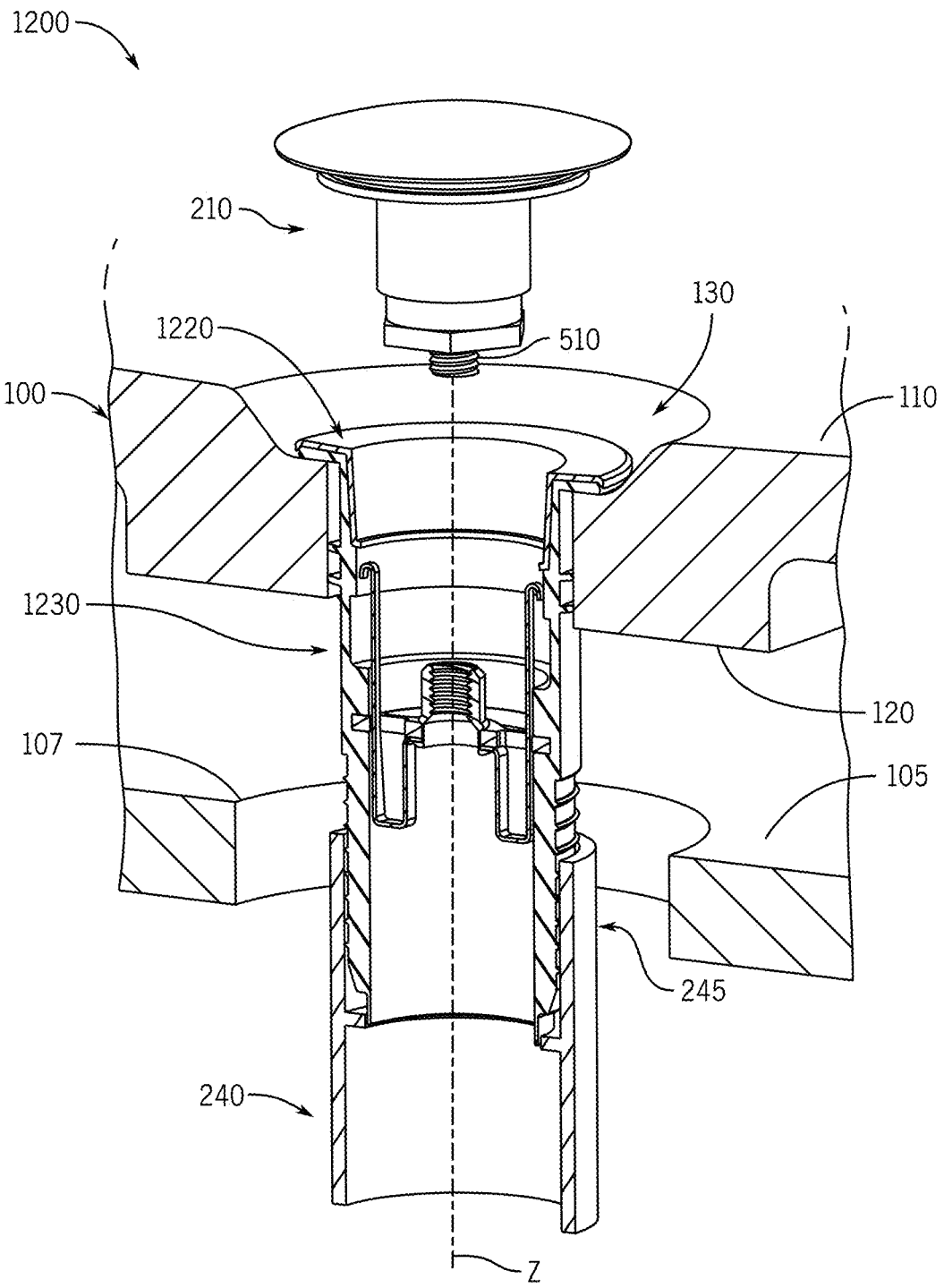
FIG. 12 shows an exploded view of a blind drain installation assembly according to yet another example embodiment.

Turning now to FIG. 12, a blind drain installation assembly 1200 is shown, according to an example embodiment. The blind drain installation assembly 1200 includes a drain body 1220 and a drain coupling 1230. In some embodiments, the blind drain installation assembly 1200 also includes the toe tap 210. The blind drain installation assembly 1200 is similar to the blind drain installation assembly 200. A difference between the blind drain installation assembly 200 and the blind drain installation assembly 1200 is that the blind drain installation assembly 1200 uses a latch assembly and an installation fixture to couple the drain body 1220 to the drain coupling 1230. In some embodiments, the drain body 1220 is coupled to the drain coupling 1230 through over-molding, adhesives, fasteners, friction fit, cold-welding, or similar coupling means. In some embodiments, the drain body 1220 and the drain coupling 1230 are formed in a single, integral body, through methods such as injection molding, die-casting, 3D printing, or similar manufacturing means.

Figure 13B:
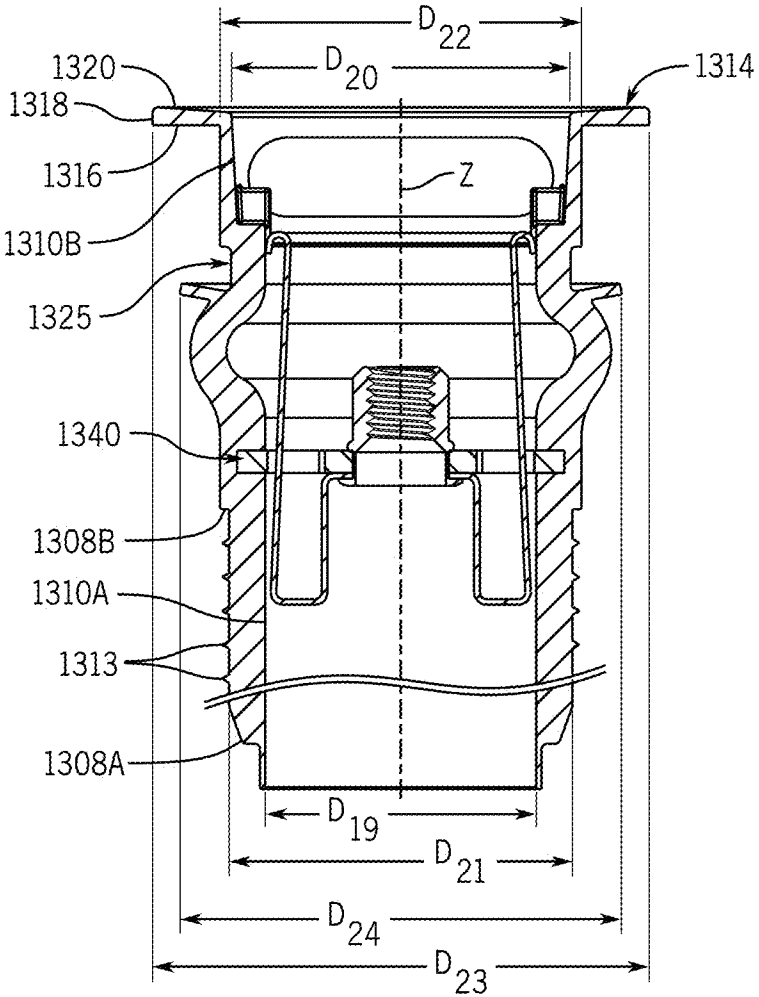
FIG. 13B shows a front, cross-section view of the portion of the blind drain installation assembly of FIG. 13A.
Figure 13A:
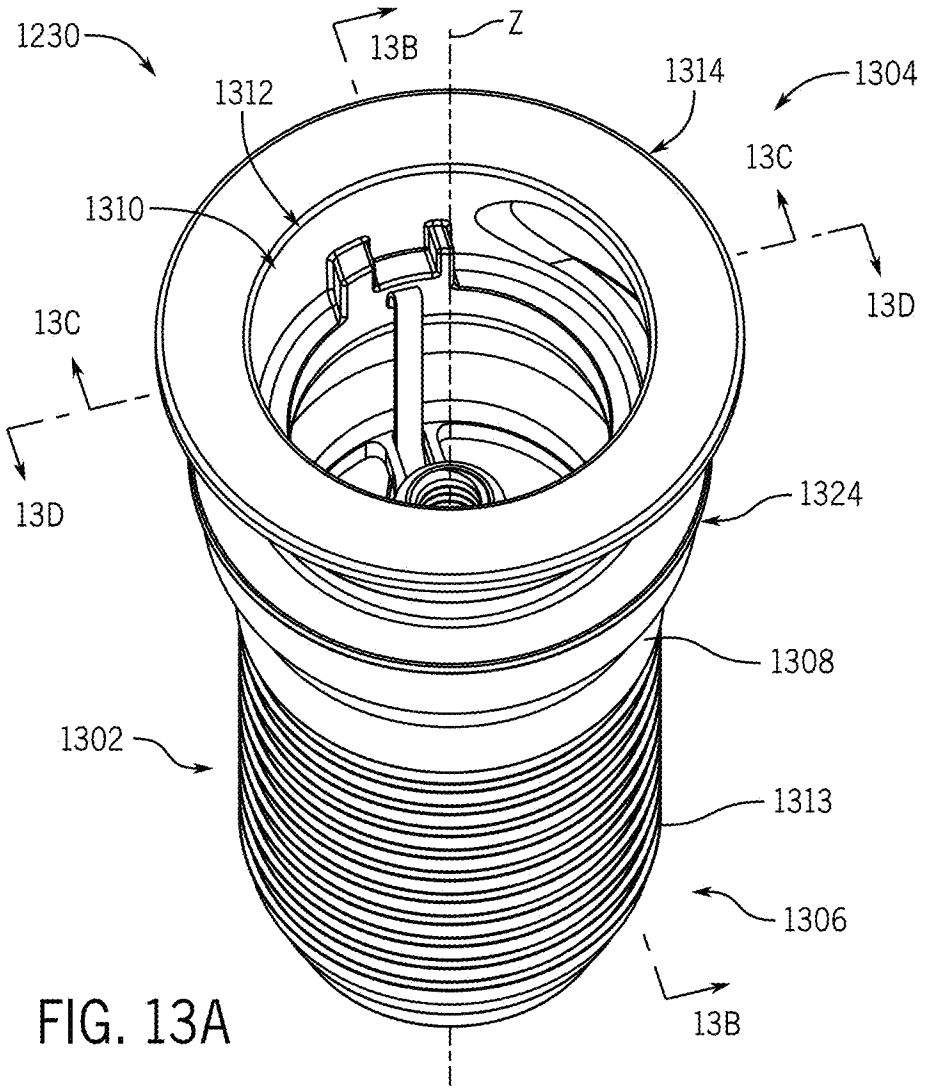
FIG. 13A shows a perspective view of a portion of the blind drain installation assembly of FIG. 12.

Referring to FIG. 13A, the drain coupling 1230 is shown. The drain coupling 1230 is similar to the drain coupling 230. A difference between the drain coupling 1230 and the drain coupling 230 is that the drain coupling 1230 is configured to be inserted into the drain pipe 240.

The drain coupling 1230 includes a generally annular first body 1302 having a first upper end 1304, a first lower end 1306, a first outer surface 1308, and a first inner surface 1310. The first outer surface 1308 and the first inner surface 1310 may be concentric about the central axis Z. The first outer surface 1308 may be configured to interface with the drain pipe 240 to provide a sealant such that a water-tight seal is formed between the drain coupling 1230 and the drain pipe 240. In some embodiments, the drain coupling 1230 is configured to be inserted into (e.g., received by) the drain pipe 240. The first outer surface 1308 may include a plurality of annular projections 1313 extending laterally away from the first outer surface 1308. As shown in FIG. 13B, the plurality of annular projections 1313 are disposed between the first lower end 1306 and approximately half-way between the first lower end 1306 and the first upper end 1304. The plurality of annular projections 1313 may be integrally manufactured to the drain coupling 1230. In some embodiments, the plurality of annular projections 1313 are manufactured separately and later coupled to the drain coupling 1230. The first inner surface 1310 may define a first inner surface first portion 1310*a*, a first inner surface second portion 1310*b*, and a drain body catch 1311. The drain body catch 1311 is contiguous with both the first inner surface first portion 1310*a* and the first inner surface second portion

1310*b*. The interface between the drain body catch 1311 and the first inner surface second portion 1310*b* may be chamfered, forming a rounded, uninterrupted transition. The drain body catch 1311 may be configured to interface with the drain body 1220 to prevent the drain body 1220 from sliding through the drain coupling 1230 and interfacing with the first inner surface first portion 1310*a*. The first inner surface second portion 1310*b* defines an orifice (e.g., a flow path, etc.), shown as a coupling opening 1312 configured to accept the drain body 1220. The drain coupling 1230 may be formed from a compressible material (e.g., neoprene, rubber, elastomer, etc.) or other suitable material configured to provide sealing engagement between the first outer surface 1308 and the drain pipe 240. In some embodiments, the drain coupling 1230 may be coupled to the drain pipe 240 such that the drain coupling 1230 stays in place relative to the drain pipe 240 as the wash basin 100 is moved around relative to the drain pipe 240.

Proximate the first lower end 1306, the first inner surface 1310 has a nineteenth diameter $D_{19}$. The first inner surface 1310 may maintain a circular cross-section of the nineteenth diameter $D_{19}$ extending from the first lower end 1306 to the drain body catch 1311. In some embodiments, the diameter of the first inner surface 1310 proximate the first upper end 1304, shown as a twentieth diameter $D_{20}$, is greater than the nineteenth diameter $D_{19}$. The first inner surface 1310 is configured to allow a flow of water to pass through. FIG. 13A shows a generally circular coupling opening 1312, although according to other embodiments, the coupling opening 1312 may be elliptical, hexagonal, octagonal, or otherwise similar to the shape of the drain body 1220. Proximate the first lower end 1306, the first outer surface 1308 has a twenty-first diameter $D_{21}$. The first outer surface 1308 may maintain a circular cross-section of the twenty-first diameter $D_{21}$ extending from the first lower end 1306 to the first upper end 1304. In some embodiments, the first outer surface 1308 proximate the first upper end 1304 defines a diameter, shown as a twenty-second diameter $D_{22}$. The twenty-first diameter $D_{21}$ may be smaller than (e.g., less than) the drain opening diameter $D_1$, the floor opening diameter $D_0$, and the twenty-second diameter $D_{22}$. In some embodiments, the drain coupling 1230 may have a taper, shown as a taper 1308*a*, proximate the first lower end 1306, tapering between the nineteenth diameter $D_{19}$ and the twenty-first diameter $D_{21}$. In some embodiments, the taper 1308*a* is continuous and gradual. In other embodiments, as shown in FIG. 13B, the taper 1308*a* may be interrupted by a lip configured to interface with a flange of the drain pipe 240. The taper 1308*a* may help direct the drain coupling 1230 into the drain pipe 240 during installation. During installation, the installer may not be able to see the drain pipe 240 and must rely on feel (e.g., tactic feedback, trail-and-error, etc.) to insert the drain coupling 1230 into the drain pipe 240. The taper 1308*a* provides a margin of error to the installer, allowing the drain coupling 1230 to slide into the drain pipe 240 even if the drain coupling 1230 is slightly off-center (e.g., not concentric, but only just) while the installer feels around for the drain pipe 240.

The drain coupling may further include a stop lip 1308*b* configured to interface with the drain pipe top 245 to prevent the drain coupling 1230 from sliding too deeply within the drain pipe 240. The stop lip 1308*b* may serve to transition the first outer surface 1308 between the twenty-first diameter $D_{21}$ and the twenty-second diameter $D_{22}$. The stop lip 1308*b* may be structured to sit on top of the drain pipe 240 during installation. In some embodiments, the stop lip 1308*b* defines little more than a change in thickness of the drain coupling 1230. While the portion of the drain coupling 1230 inserted into the drain pipe 240 may have one thickness, it may be desirable for the portion of the drain coupling 1230 extending out of the drain pipe 240 to have a different, and possibly greater, thickness. Varying the thickness of the portion of the drain coupling 1230 extending out of the drain pipe 240 may affect the compliance of the drain coupling 1230, and thus the resulting forces of a squeeze bulge of the drain coupling 1230 formed during installation.

The drain coupling 1230 may further include generally annular first flange 1314 extending laterally outwardly from (e.g., orthogonally to) the first outer surface 1308. As shown in FIG. 13B, the first flange 1314 extends from the first upper end 1304 of the first body 1302. In some embodiments, the first flange 1314 may extend outwardly from the first outer surface 1308 at other heights such that at least a portion of the first body 1302 extends above the first flange 1314 (e.g., between the first flange 1314 and the first upper end 1304). The first flange 1314 has a twenty-third diameter $D_{23}$. The twenty-third diameter $D_{23}$ may be greater than the drain opening diameter $D_1$. The first flange 1314 is configured to interface with the top basin surface 110 to form a watertight seal such that a flow of water is not able to exist between the top basin surface 110 and the first flange 1314.

The first flange 1314 includes a first flange first surface 1316, a first flange second surface 1318, and a first flange third surface 1320. The first flange first surface 1316 is disposed at an underside of the first flange 1314 and is configured to cooperate and interface with the top basin surface 110 such that a water-tight seal is created between the first flange 1314 and the top basin surface 110. The first flange first surface 1316 extends laterally outwardly from and is generally perpendicular to and contiguous with the first outer surface 1308. In some embodiments, the first flange first surface 1316 projects outwardly from the first outer surface 1308 at an angle that is not perpendicular. The first flange second surface 1318 is contiguous with the first flange first surface 1316. The first flange second surface 1318 may be concentric about the center axis Z and may have the twenty-third diameter $D_{23}$. The first flange second surface 1318 may be parallel with the first outer surface 1308. The first flange third surface 1320 is contiguous with the first flange second surface 1318 and may be parallel to the first flange first surface 1316. The first flange third surface 1320 is disposed proximate the first upper end 1304. The first flange third surface 1320 is configured to interface with a portion of the drain body 1220 to create a watertight seal between the drain coupling 1230 and the drain body 1220 such that a flow of water is prevented from flowing between the first flange third surface 1320 and the drain body 1220. The first flange third surface 1320 is contiguous with the first inner surface 1310. The first flange third surface 1320 and the first inner surface 1310 may meet at a corner. In some embodiments, the corner is chamfered (e.g., filleted, rounded, blunted, etc.) such that the transition between the first flange third surface 1320 and the first inner surface 1310 is uninterrupted (e.g., smooth, rounded, etc.).

The drain coupling 1230 may further include a generally annular second flange, shown as a centering ring 1324, extends laterally outwardly from (e.g., orthogonally to) the first outer surface 1308 and defines a twenty-fourth diameter $D_{24}$. As shown in FIG. 13B, the centering ring 1324 is proximate the first upper end 1304, but is positioned below the first flange 1314 such that at least a portion of the first body 1302 extends between the first flange 1314 and the centering ring 1324. The centering ring 1324 is structured to interface with the drain opening 130 to center the drain coupling 1230 about the central axis Z within the drain opening 130. In some embodiments, when the drain coupling 1230 is installed, the centering ring 1324 is disposed between the top basin surface 110 and the bottom basin surface 120. The inherent compliance of the centering ring 1324 allows the centering ring 1324 to conform to drain openings of various sizes. For example, suppose the drain opening 130 defines a diameter (e.g., $D_1$) equal to the twenty-fourth diameter $D_{24}$. In such a case, the centering ring 1324 would serve to center the drain coupling 1230 within the drain opening 130. Attempted movement of the drain coupling 1230 off-center would be inhibited by the compliant nature of the centering ring 1324. In another example, suppose the drain opening 130 defines a diameter (e.g., $D_1$) approximately equal to the twenty-second diameter $D_{22}$. In such an embodiment, the centering ring 1324 may be biased toward the center axis Z and within a ring cavity 1325, biased by the drain opening 130. The ring cavity 1325 provides clearance to the centering ring 1324 to avoid situations where an installer may need to remove the centering ring 1324 before installing the drain coupling 1230 to fit into a drain opening (e.g., the drain opening 130) having little to no clearance for the centering ring 1324. In embodiments where the drain opening 130 defines a diameter between the two extremes defined above (e.g., $D_1$ is between $D_{24}$ and $D_{22}$), the compliance of the centering ring 1324 may bias the drain coupling 1230 to be concentric about the central axis Z. In some embodiments, the drain coupling 1230 may include more than one centering ring 1324 and more than one ring cavity 1325.

The drain coupling 1230 further includes a generally annular flange, shown as a first lattice 1340. The first lattice 1340 is similar to the first lattice 840. A difference between the first lattice 1340 and the first lattice 840 is that the first lattice 1340 is configured to cooperate with a nut to couple a latch body to the first lattice 1340. The first lattice 1340 extends orthogonally away from the first inner surface 1310 and may be disposed approximately half-way between the first lower end 1306 and the first upper end 1304. In some embodiments, the first lattice 1340 is positioned nearer the first upper end 1304 than the first lower end 1306. In some embodiments, the annular projections 1313 extend between the first lower end 1306 and the first lattice 1340. In some embodiments, the stop lip **1308*b* is positioned nearer the first lower end 1306 than the first lattice 1340. This structure may be desirable to prevent the first lattice 1340 from being disposed within the drain pipe 240, preventing undue stress on the first lattice 1340 that may be caused as a result of improperly forcing the first lattice 1340 within the drain pipe 240. In some embodiments, the position of the stop lip 1308*b* may not depend upon the positon of the first lattice 1340. The first lattice 1340 may be manufactured from brass, steel, aluminum, plastic, titanium, rubber, or similar materials. The first lattice 1340 may be manufactured into the first inner surface 1310 such that the drain coupling 1230 and the first lattice 1340 are a single body (e.g., all one piece, etc.). In some embodiments, the first lattice 1340 is manufactured separately from the drain coupling 1230 and later coupled to the drain coupling 1230** by over-molding, fasteners, interference fit, friction, adhesives, glue, or by similar coupling means.

Figure 13D:
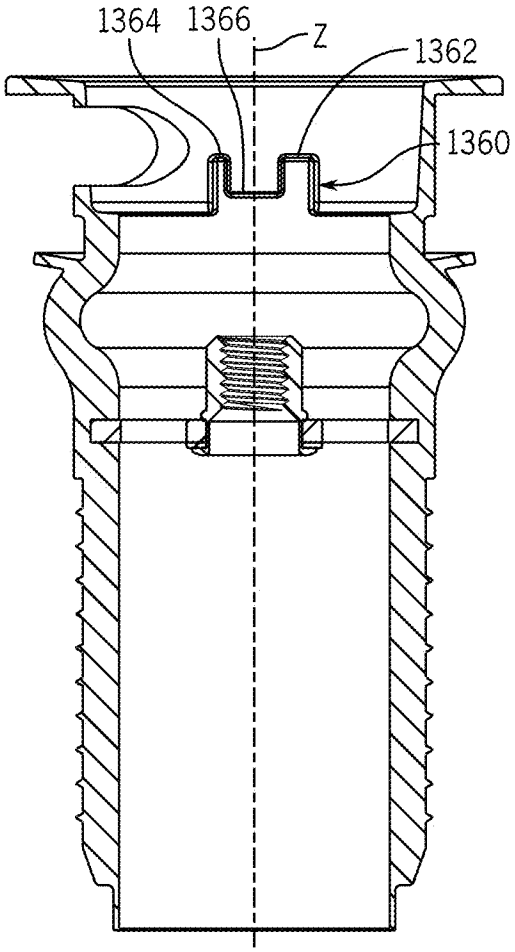
FIG. 13D shows a right, cross-section view of the portion of the blind drain installation assembly of FIG. 13A.
Figure 13C:
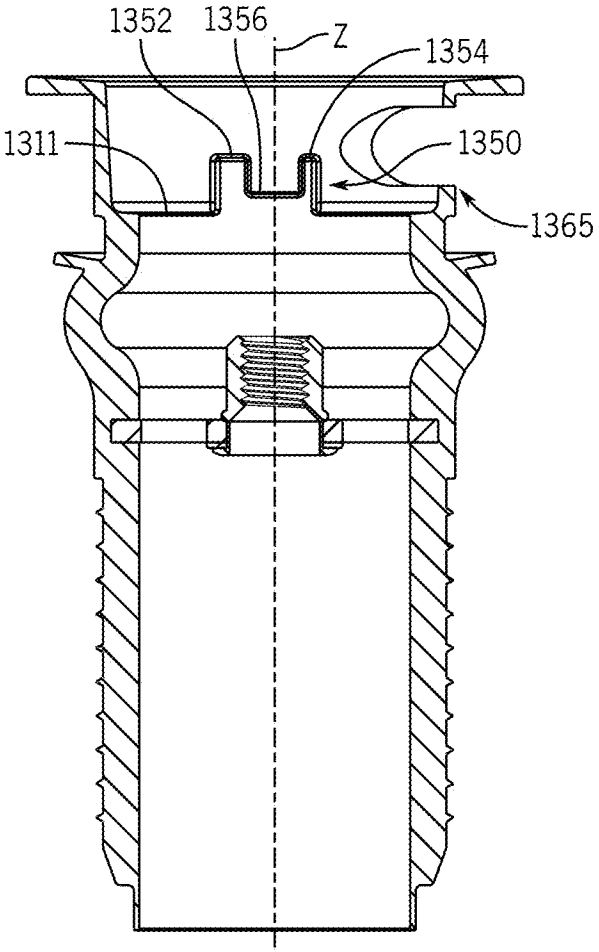
FIG. 13C shows a left, cross-section view of the portion of the blind drain installation assembly of FIG. 13A.

As shown in FIG. 13C, the drain coupling 1230 may further include a projection, shown as a first fixture projection 1350. The first fixture projection 1350 may define a first fixture projection first portion 1352, a first fixture projection second portion 1354, and a first fixture projection seat portion 1356. The first fixture projection 1350 is configured to interface with the drain body 1220 and may prevent rotation of the drain body 1220 about the central axis Z relative to the drain coupling 1230. As shown, the first fixture projection 1350 has an asymmetrical profile (e.g., the first fixture projection first portion 1352 is not a mirror image of the first fixture projection second portion 1354). The asymmetrical profile assists the installer of the blind drain installation assembly 1200 during the installation process. As a result of the asymmetrical profile, the drain body 1220 will only be properly set (e.g., sit flush against the drain body catch 1311) in a single position, the first fixture projection 1350 acting as a fixture to properly align the drain body 1220 within the drain coupling 1230. As shown, the drain coupling 1230 includes a first overflow aperture 1365 off-set to one side of the drain coupling 1230. The first fixture projection 1350 may align the drain body 1220 within the drain coupling 1230 such that the first overflow aperture 1365 of the drain coupling 1230 is aligned with (e.g., in fluid communication with) an overflow aperture of the drain body 1220. In some embodiments, the first fixture projection 1350 has a symmetrical profile, allowing the drain body 1220 to be seated within the drain coupling 1230 in two orientations, 180 rotational degrees different. In some embodiments, the drain coupling 1230 does not include a fixture projection, allowing the drain body 1220 to be seated within the drain coupling 1230 in one of the many positions possible without the inclusion of such a fixture projection.

As shown in FIG. 13D, the drain coupling 1230 may further include a projection, shown as a second fixture projection 1360. The second fixture projection 1360 may define a second fixture projection first portion 1362, a second fixture projection second portion 1364, and a second fixture projection seat portion 1366. The second fixture projection 1360 is configured to interface with the drain body 1220 and may prevent rotation of the drain body 1220 about the central axis Z relative to the drain coupling 1230. As shown, the second fixture projection 1360 has an asymmetrical profile (e.g., the second fixture projection first portion 1362 is not a mirror image of the second fixture projection second portion 1364). The asymmetrical profile assists the installer of the blind drain installation assembly 1200 during the installation process. As a result of the asymmetrical profile, the drain body 1220 will only be properly set (e.g., sit flush against the drain body catch 1311) in a single position, the second fixture projection 1360 acting as a fixture to properly align the drain body 1220 within the drain coupling 1230. As shown, the drain coupling 1230 includes a first overflow aperture 1365 off-set to one side of the drain coupling 1230. The second fixture projection 1360 may align the drain body 1220 within the drain coupling 1230 such that the first overflow aperture 1365 of the drain coupling 1230 is aligned with (e.g., in fluid communication with) an overflow aperture of the drain body 1220. In some embodiments, the second fixture projection 1360 has a symmetrical profile, allowing the drain body 1220 to be seated within the drain coupling 1230 in two orientations, 180 rotational degrees different. In some embodiments, the drain coupling 1230 does not include a fixture projection, allowing the drain body 1220 to be seated within the drain coupling 1230 in one of the many positions possible without the inclusion of such a fixture projection.

Figure 14B:
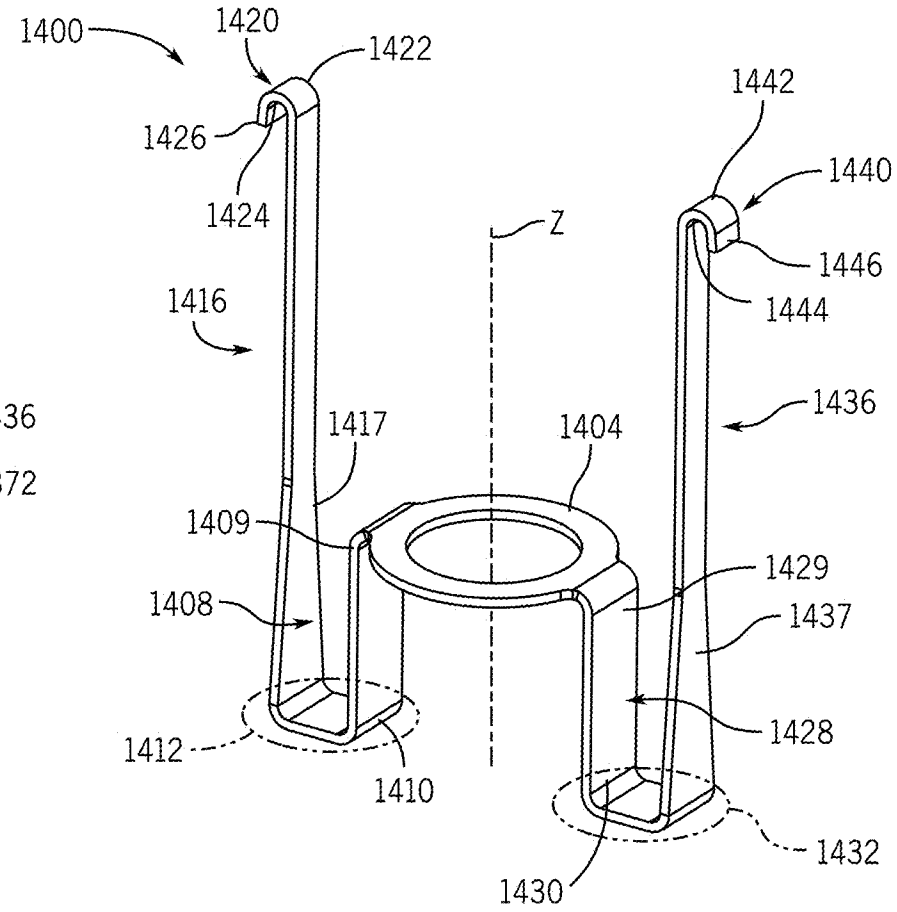
FIG. 14B shows a close-up perspective view of a portion of the portion of the blind drain installation assembly of FIG. 14A.
Figure 14A:
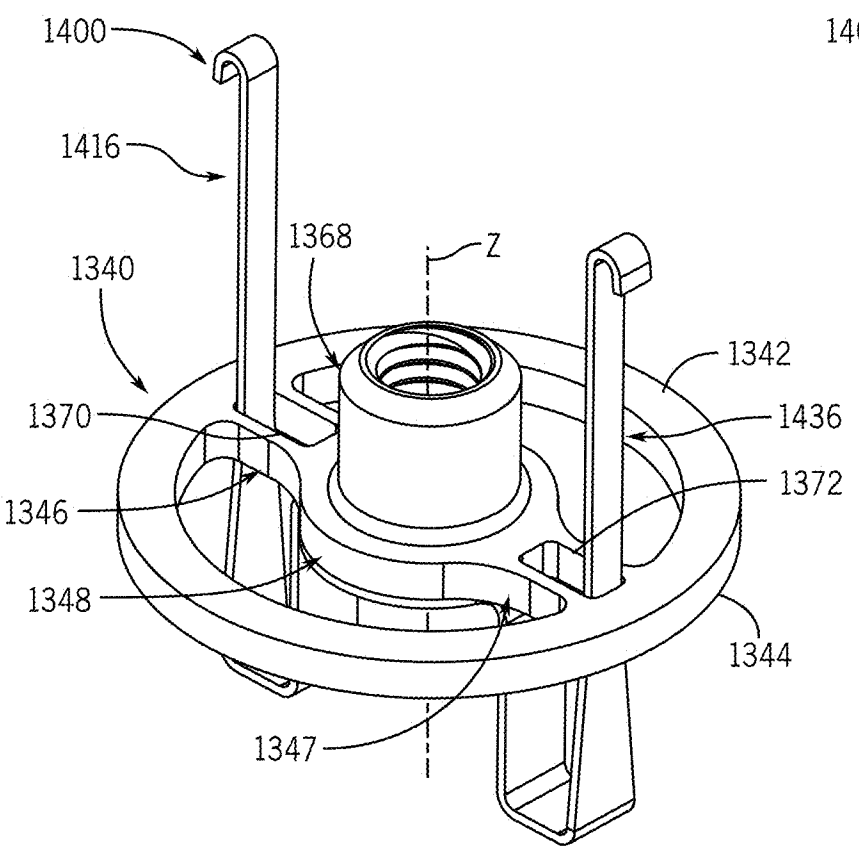
FIG. 14A shows a close-up perspective view of a portion of the portion of the blind drain installation assembly of FIG. 13A

Referring now to FIG. 14A, a close-up perspective view of the first lattice 1340 is shown, removed from the drain coupling 1230. The first lattice 1340 defines a generally planar top first lattice surface 1342 and a generally planar bottom first lattice surface 1344. Extending through both the top first lattice surface 1342 and the bottom first lattice surface 1344 may be a plurality of slots configured to allow a flow of water to pass through the first lattice 1340. As shown in FIG. 14A, the first lattice 1340 may include a first support structure 1346 and a second support structure 1347, extending laterally away from the first inner surface 1310 and toward the central axis Z. The first support structure 1346 and the second support structure 1347 are configured to allow a flow of water to pass through the drain coupling 1230. The first support structure 1346 and the second support structure 1347 cooperate proximate the central axis Z to form an annular first coupling body 1348. The first coupling body 1348 defines a first orifice (hidden by nut 1368) concentric about the central axis Z and configured to receive a nut 1368. The nut 1368 is configured to couple the first lattice 1340 to a compliant body, shown as a latch body 1400. The nut 1368 may be one of a rivet nut, a heavy-duty rivet nut, a metal rivet nut, or similar fastener. The nut 1368 is concentric about the central axis Z. The nut 1368 is configured to prevent separation of the first lattice 1340 from the latch body 1400. During installation of the drain body 1220 to the drain coupling 1230, the nut 1368 is configured to receive an installation fixture and the toe tap 210.

Turning to FIG. 14B, the latch body 1400 is shown, removed from the first lattice 1340. The latch body 1400 comprises a ring 1404, a first arm 1408, a first compliant portion 1412, a first finger 1416, and a first latch 1420. The latch body 1400 may be manufactured from a single piece of metal, wood, plastic, polymer, or similar material. In some embodiments, each component of the latch body 1400 may be manufactured separately and later coupled together, forming the latch body 1400. The ring 1404 comprises an orifice concentric about both the central axis Z and the first orifice of the first lattice 1340, and configured to accept the nut 1368. The top of the ring is configured to interface with the bottom first lattice surface 1344 when the nut 1368 is installed. The first arm (e.g., cantilever) 1408 includes a first arm first end 1409 and a first arm second end 1410. The first arm first end 1409 is coupled to the ring 1404 such that the first arm 1408 extends perpendicularly away from the ring 1404 in a direction generally away from the first lattice 1340. In some embodiments, the first arm 1408 is contiguous with the ring 1404 at a rounded corner such as to disperse stress concentrations caused at the interface between the ring 1404 and the first arm 1408 when the first arm 1408 is biased toward and away from the central axis Z. The first arm 1408 and the ring 1404 may be manufactured from a single piece of metal, plastic, polymer, wood, or similar material.

The first arm 1408 is also coupled to the first compliant portion 1412 proximate the first arm second end 1410. As shown in FIG. 14B, the first compliant portion 1412 has a U-shaped profile, facilitating movement of the first finger 1416 toward and away from the first arm 1408. However, in some embodiments, the first compliant portion 1412 may have a zig-zag, wavy, accordion, V-shaped, or similar shaped profile to facilitate movement of the first finger 1416 toward and away from the first arm 1408. The first compliant portion 1412 and the first arm 1408 may be manufactured from the same piece of material.

Extending away from the first compliant portion 1412 is the first finger 1416. The first finger 1416 may extend perpendicularly away from the first compliant portion 1412 in a direction generally parallel to the first arm 1408. The first finger 1416 may include a triangular base portion, shown as a first finger base 1417. The contour of the first finger base 1417 may add rigidity to the first finger 1416 such that more force would be required to bias the first finger 1416 toward the central axis Z, and thus toward the first arm 1408, than would be required by a finger not having a contoured finger base. The contours and the profile of the first finger base 1417 may be adjusted to meet the installation needs of the drain coupling 1230. The first finger base 1417 may be manufactured to have a wider (e.g., thicker) profile, such as to increase the rigidity of the first finger 1416. In some embodiments, the first finger base 1417 may be thinned (e.g., made less thick, made less wide, etc.) such as to decrease the rigidity of the first finger 1416 and lowering the amount of force required to bias the first finger 1416 toward and away from the central axis Z.

As shown in FIG. 14A, the first finger 1416 extends through the first lattice 1340. More specifically, the first lattice 1340 includes a first lattice slot 1370 configured to receive the first finger 1416 and facilitate movement of the first finger 1416 toward and away from the central axis Z. In some embodiments, the first lattice slot 1370 is defined by the first support structure 1346, allowing the first finger 1416 to extend through the first support structure 1346. The first finger base 1417 may be contoured such as to prevent translational movement of the first finger 1416 through the first lattice slot 1370 in a direction generally away from the first compliant portion 1412.

Referring again to FIG. 14B, the first finger 1416 also includes, opposite the first finger base 1417, the first latch 1420. The first latch 1420 may be integral with the first finger 1416 such that the first latch 1420 and the first finger 1416 are manufactured from the same piece of material. The first latch 1420 defines a first latch extrados 1422, a first latch intrados 1424, and a first latch end 1426. The first latch extrados 1422 is configured to interface with the drain body 1220 during the Installation of the drain body 1220 to the drain coupling 1230. As will be explained in further detail herein (FIGS. 16A-16D), the interaction between the drain body 1220 and the first latch extrados 1422 biases the first finger 1416 toward the central axis Z. The first latch intrados 1424 is configured to interface with the drain body 1220 to couple the drain coupling 1230 to the drain body 1220. The first latch 1420 may be further configured to prevent the first finger 1416 from sliding through and out of the first lattice slot 1370 in a direction generally toward the first compliant portion 1412. The first latch end 1426 extends in a direction generally toward the first finger base 1417.

The latch body 1400 may further include a second arm 1428, a second compliant portion 1432, a second finger 1436, and a second latch 1440. The second arm (e.g., cantilever) 1428 includes a second arm first end 1429 and a second arm second end 1430. The second arm first end 1429 is coupled to the ring 1404 such that the second arm 1428 extends perpendicularly away from the ring 1404 in a direction generally away from the first lattice 1340. In some embodiments, the second arm 1428 is contiguous with the ring 1404 at a rounded corner such as to disperse stress concentrations caused at the interface between the ring 1404 and the second arm 1428 when the second arm 1428 is biased toward and away from the central axis Z. The second arm 1428 and the ring 1404 may be manufactured from a single piece of metal, plastic, polymer, wood, or similar material.

The second arm 1428 is also coupled to the second compliant portion 1432 proximate the second arm second end 1430. As shown in FIG. 14B, the second compliant portion 1432 has a U-shaped profile, facilitating movement of the second finger 1436 toward and away from the second arm 1428. However, in some embodiments, the second compliant portion 1432 may have a zig-zag, wavy, accordion, V-shaped, or similar shaped profile to facilitate movement of the second finger 1436 toward and away from the second arm 1428. It is not necessary for the profile of the first compliant portion 1412 to match or be the same as the profile of the second compliant portion 1432. It may be desirable to give the second compliant portion 1432 a different profile than the first compliant portion 1412 to differentiate the amount of force required to bias the second finger 1436 from the amount of force required to bias the first finger 1416. The second compliant portion 1432 and the second arm 1428 may be manufactured from the same piece of material.

Extending away from the second compliant portion 1432 is the second finger 1436. The second finger 1436 may extend perpendicularly away from the second compliant portion 1432 in a direction generally parallel to the second arm 1428. The second finger 1436 may include a triangular base portion, shown as a second finger base 1437. The contour of the second finger base 1437 may add rigidity to the second finger 1436 such that more force would be required to bias the second finger 1436 toward the central axis Z, and thus toward the second arm 1428, than would be required by a finger not having a contoured finger base. In some embodiments, the first finger base 1417 and the second finger base 1437 have different contours are profiles, allowing the first finger 1416 to demonstrate different properties (e.g., force to bias, rigidity, cycle life, etc.) than the second finger 1436. The contours and the profile of the second finger base 1437 may be adjusted to meet the installation needs of the drain coupling 1230. The second finger base 1437 may be manufactured to have a wider (e.g., thicker) profile, such as to increase the rigidity of the second finger 1436. In some embodiments, the second finger base 1437 may be thinned (e.g., made less thick, made less wide, etc.) such as to decrease the rigidity of the second finger 1436 and lowering the amount of force required to bias the second finger 1436 toward and away from the central axis Z.

As shown in FIG. 14A, the second finger 1436 extends through the first lattice 1340. More specifically, the first lattice 1340 includes a second lattice slot 1372 configured to receive the second finger 1436 and facilitate movement of the second finger 1436 toward and away from the central axis Z. In some embodiments, the second lattice slot 1372 is defined by the second support structure 1347, allowing the second finger 1436 to extend through the second support structure 1347. The second finger base 1437 may be contoured such as to prevent translational movement of the second finger 1436 through the second lattice slot 1372 in a direction generally away from the second compliant portion 1432.

Referring again to FIG. 14B, the second finger 1436 also includes, opposite the second finger base 1437, the second latch 1440. The second latch 1440 may be integral with the second finger 1436 such that the second latch 1440 and the second finger 1436 are manufactured from the same piece of material. The second latch 1440 defines a second latch extrados 1442, a second latch intrados 1444, and a second latch end 1446. The second latch extrados 1442 is configured to interface with the drain body 1220 during the installation of the drain body 1220 to the drain coupling 1230. As will be explained in further detail herein (FIGS. 16A-16D), the interaction between the drain body 1220 and the second latch extrados 1442 biases the second finger 1436 toward the central axis Z. The second latch intrados 1444 is configured to interface with the drain body 1220 to couple the drain coupling 1230 to the drain body 1220. The second latch 1440 may be further configured to prevent the second finger 1436 from sliding through and out of the second lattice slot 1372 in a direction generally toward the second compliant portion 1432. The second latch end 1446 extends in a direction generally toward the second finger base 1437.

Figure 15B:
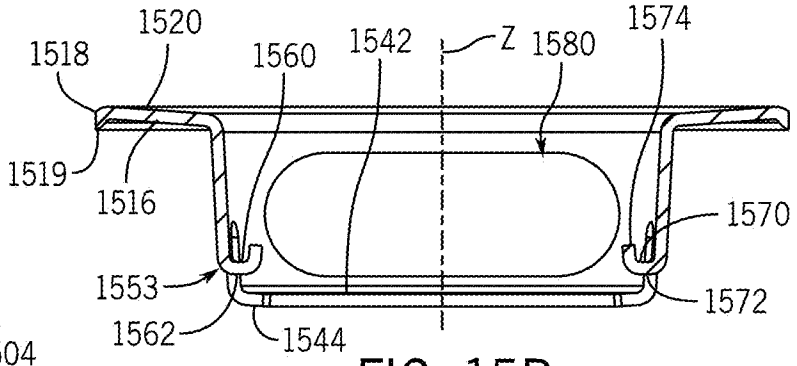
FIG. 15B shows a front, cross-section view of the portion of the blind drain installation assembly of FIG. 15A.
Figure 15C:
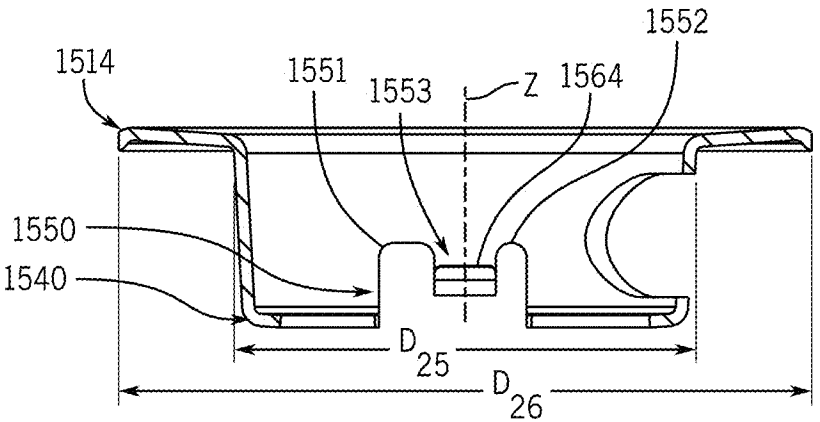
FIG. 15C shows a left, cross-section view of the portion of the blind drain installation assembly of FIG. 15A.
Figure 15A:
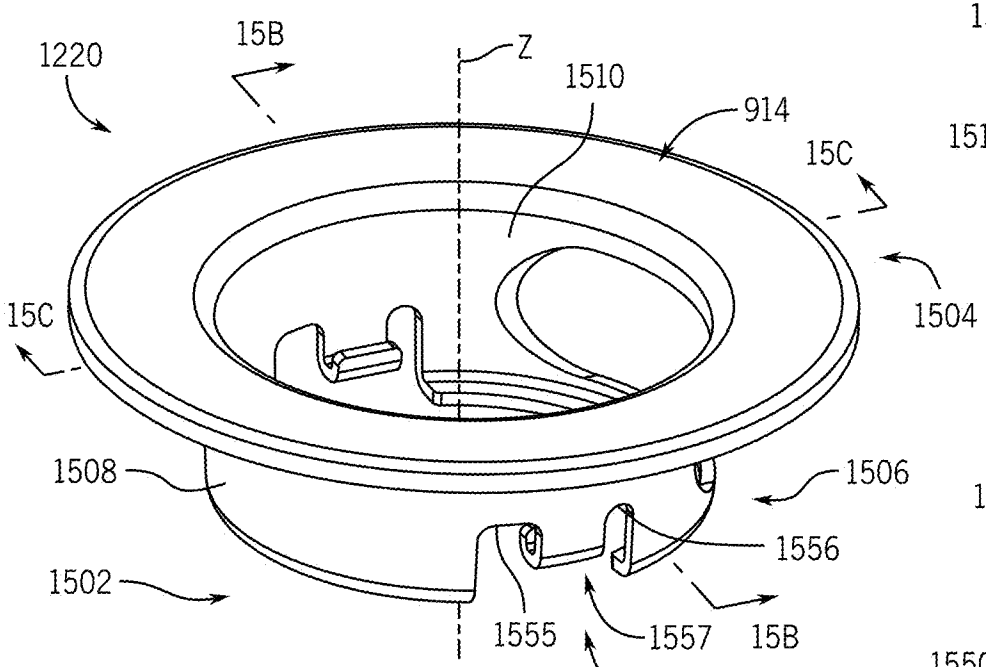
FIG. 15A shows a perspective view of a portion of the blind drain installation assembly of FIG. 12.

Turning to FIG. 15A, the drain body 1220 is shown according to an example embodiment. The drain body 1220 is similar to the drain body 220. A difference between the drain body 1220 and the drain body 220 is that the drain body 1220 is coupled to the drain coupling 1230 using the latch body 1400.

The drain body 1220 includes a generally annular second body 1502 having a second upper end 1504, a second lower end 1506, a second outer surface 1508, and a second inner surface 1510. The second outer surface 1508 and the second inner surface 1510 are concentric about the central axis Z. The second outer surface 1508 has a circular cross-section of a twenty-fifth diameter $D_{25}$ proximate the second upper end 1504. The twenty-fifth diameter $D_{25}$ is approximately equal to the twentieth diameter $D_{20}$. Generally, the drain body 1220 may be shaped to be accepted by the drain coupling 1230. More specifically, the second outer surface 1508 may be shaped to interface with the second inner surface first portion 1310*b*.

The drain body 1220 further includes a generally annular second flange 1514 extending laterally outwardly from (e.g., orthogonal to) the second outer surface 1508. As shown in FIG. 15B, the second flange 1514 extends outwardly from the second upper end 1504. In some embodiments, the second flange 1514 may extend from the second outer surface 1508 at other heights such that a portion of the second body 1502 extends above the second flange 1514 (e.g., between the second flange 1514 and the second upper end 1504.) The second flange 1514 has a twenty-sixth diameter $D_{26}$. The twenty-sixth diameter $D_{26}$ may be generally equal to the twenty-third diameter $D_{23}$. In some embodiments, the twenty-sixth diameter $D_{26}$ may be slightly greater than the twenty-third diameter $D_{23}$. In some embodiments, the twenty-sixth diameter $D_{26}$ may be slightly less than the twenty-third diameter $D_{23}$. The twenty-sixth diameter $D_{26}$ is greater the drain opening diameter $D_1$.

The second flange 1514 includes a second flange first surface 1516, a second flange second surface 1518, and a second flange third surface 1520. The second flange first surface 1516 is contiguous with and concentric about the second outer surface 1508. In some embodiments, the second flange first surface 1516 is perpendicular to the second outer surface 1508. In other embodiments, the second flange first surface 1516 meets the second outer surface 1508 at an angle other than perpendicular. In some embodiments, the transition from second flange first surface 1516 to the second outer surface 1508 is rounded. This rounded interface between the second outer surface 1508 and the second flange first surface 1516 may assist in biasing the first flange 1314 toward the surfaces defining the drain opening 130 to create a watertight seal between the top basin surface 110, the first flange 1314, and the second flange 1514.

The second flange first surface 1516 is contiguous with the second flange second surface 1518. The second flange second surface 1518 may be concentric about the central axis Z. The second flange second surface 1518 may extend below the second flange first surface 1516, forming a tooth 1519. The tooth 1519 may be structured to grip into the first flange 1314, improving the contact between the first flange 1314 and the top basin surface 110. The tooth 1519 may also prevent rotational motion of the drain body 1220 relative to the drain coupling 1230 during installation or regular use. In embodiments where the twenty-sixth diameter $D_{26}$ may be slightly greater than the twenty-third diameter $D_{23}$, the tooth 1519 may direct the squeeze of the first flange 1314 downward and toward the top basin surface 110, improving the contact between the top basin surface 110 and the first flange 1314, and further improving the aesthetic appearance of the installed blind drain installation assembly 1200 by preventing the first flange 1314 from squeezing beyond the second flange 1514 and within sight of a viewer from within the wash basin 100.

The second flange second surface 1518 is contiguous with the second flange third surface 1520. The second flange third surface 1520 may meet the second flange first surface 1516 at a corner such that there is no second flange second surface 1518. In some embodiments, the second flange second surface 1518 is chamfered such that the transition between the second flange first surface 1516 and the second flange third surface 1520 is smooth (e.g., rounded, uninterrupted, etc.). The second flange third surface 1520 is also contiguous with the second inner surface 1510. The second flange third surface 1520 may be perpendicular to and concentric about the second inner surface 1510. In some embodiments, where the second flange third surface 1520 and the second inner surface 1510 meet may be chamfered such that the transition from the second flange third surface 1520 to the second inner surface 1510 is uninterrupted by a sharp corner or similar discontinuity (e.g., smooth, rounded, continuous, etc.).

The drain body 1220 further includes a generally annular flange, shown as a third flange (e.g., body flange) 1540. The third flange 1540 extends laterally away from the second inner surface 1510 and toward the central axis Z. As shown in FIG. 15C, the third flange 1540 extends inwardly from the second lower end 1506. In some embodiments, the third flange 1540 is disposed at a different height, such that a portion of the second inner surface 1510 is disposed between the third flange 1540 and the second lower end 1506. The third flange 1540 includes a top third flange surface 1542 and a bottom third flange surface 1544. The top third flange surface 1542 is contiguous with the second inner surface 1510, and the bottom third flange surface 1544 is contiguous with the second outer surface 1508. The bottom third flange surface 1544 is configured to interface with the drain body catch 1311 to prevent translational movement of the drain body 1220 relative to the drain coupling 1230 along the central axis Z. In some embodiments, the bottom third flange surface 1544 is textured with teeth, bumps, cuts, or similar textures to grip to (e.g., dig into, bite into etc.) the drain body catch 1311 to prevent rotational motion of the drain body 1220 relative to the drain coupling 1230.

Interrupting the third flange 1540 is a first cut-out 1550 and a second cut-out 1554. As shown in FIG. 15C, the first cut-out 1550 has a first cut-out first portion 1551 and a first cut-out second portion 1552. When the drain body 1220 is inserted within the drain coupling 1230, the first cut-out 1550 interfaces with the first fixture projection 1350, cooperating to prevent rotational motion of the drain body 1220 about the central axis Z relative to the drain coupling 1230. Similar to the first fixture projection 1350, the first cut-out 1550 has an asymmetrical profile. More specifically, when installed, the fixture projection first portion 1352 is disposed within the first cut-out first portion 1551 and the first fixture projection second portion 1354 is disposed within the first cut-out second portion 1552. Positioned between the first cut-out first portion 1551 and the first cut-out second portion 1552 is a first hook 1553. The first hook 1553 is configured to interface with the first latch 1420 of the first finger 1416 to couple the drain body 1220 to the drain coupling 1230.

Referring now to FIG. 15A, the second cut-out 1554 is similar to the first cut-out 1550, as the second cut-out 1554 defines a second cut-out first portion 1555 and a second cut-out second portion 1556. When the drain body 1220 is inserted within the drain coupling 1230, the second cut-out 1554 interfaces with the second fixture projection 1360 cooperating to prevent rotational motion of the drain body 1220 about the central axis Z relative to the drain coupling 1230. Similar to the second fixture projection 1360, the second cut-out 1554 has an asymmetrical profile. More specifically, when installed, the second fixture projection first portion 1362 is disposed within the second cut-out first portion 1555 and the second fixture projection second portion 1364 is disposed within the second cut-out second portion 1556. Positioned between the second cut-out first portion 1555 and the second cut-out second portion 1556 is a second hook 1557. The second hook 1557 is configured to interface with the second latch 1440 of the second finger 1436 to couple the drain body 1220 to the drain coupling 1230.

The first hook 1553 has a first hook intrados 1560, a first hook extrados 1562, and a first hook end 1564. The first hook 1553 latches to (e.g., hooks onto, etc.) the first latch 1420. Preferably, when the blind drain installation assembly 1200 is fully assembled, the first hook end 1564 interfaces with the first latch intrados 1424, and the first latch end 1426 interfaces with the first hook intrados 1560. However, slight variations in manufacturing may cause only one such interface to occur (e.g., the first latch end 1426 is shorter than the first hook end 1564, causing the first hook end 1564 to interface with the first latch intrados 1424, such that the first latch end 1426 does not interface with the first hook intrados 1560, and vice versa).

Similarly, the second hook 1557 has a second hook intrados 1570, a second hook extrados 1572, and a second hook end 1574. The second hook 1557 latches to (e.g., hooks onto, etc.) the second latch 1440. Preferably, when the blind drain installation assembly 1200 is fully assembled, the second hook end 1574 interfaces with the second latch intrados 1444, and the second latch end 1446 interfaces with the second hook intrados 1570. However, slight variations in manufacturing may cause only one such interface to occur (e.g., the second latch end 1446 is shorter than the second hook end 1574, causing the second hook end 1574 to interface with the second latch intrados 1444, such that the second latch end 1446 does not interface with the second hook intrados 1570, and vice versa).

In embodiments where the first fixture projection 1350 and the second fixture projection 1360 allow for the drain body 1220 to be positioned within the drain coupling 1230 in two positions, separated by 180 degrees, it may occur that the first hook 1553 interfaces with the second latch 1440 and the second hook 1557 interfaces with the first latch 1420.

The drain body 1220 may further include a second overflow aperture 1580. The second overflow aperture 1580 extends through the second inner surface 1510 and the second outer surface 1508. The second overflow aperture 1580 may be in fluid communication with the first overflow aperture 1365 of the drain coupling 1230. As shown in FIG. 15A, the second overflow aperture 1580 is defined on one side of the drain body 1220 (e.g., the second overflow aperture 1580 is not mirrored by a similar aperture). During installation, it may be desirable to align the second overflow aperture 1580 with the first overflow aperture 1365. Aligning these two apertures may be facilitated by the first fixture projection 1350 and the first cut-out 1550. Similarly, aligning these two apertures may be facilitated through cooperation between the first fixture projection 1350 and the second fixture projection 1360.

Turning now to FIGS. 16A-16D, the installation of the blind drain installation assembly 1200 is shown. Prior to installation, the drain coupling 1230 may be assembled to include the first lattice 1340, the nut 1368, and the latch body 1400. In some embodiments, the installer may receive the drain coupling 1230 fully assembled and ready for installation in the wash basin 100. The installation of the blind drain installation assembly 1200 is similar to the installation of the blind drain installation assembly 700. A difference between the two installations is that the blind drain installation assembly 1200 utilizes an installation fixture to couple the drain coupling 1230 to the drain body 1220. More specifically, the installation of the blind drain installation assembly 1200 uses an installation fixture to bias the first lattice 1340 toward the drain body 1220 via the nut 1368, pulling the first latch 1420 above the first hook 1553 and the second latch 1440 above the second hook 1557.

Figure 16B:
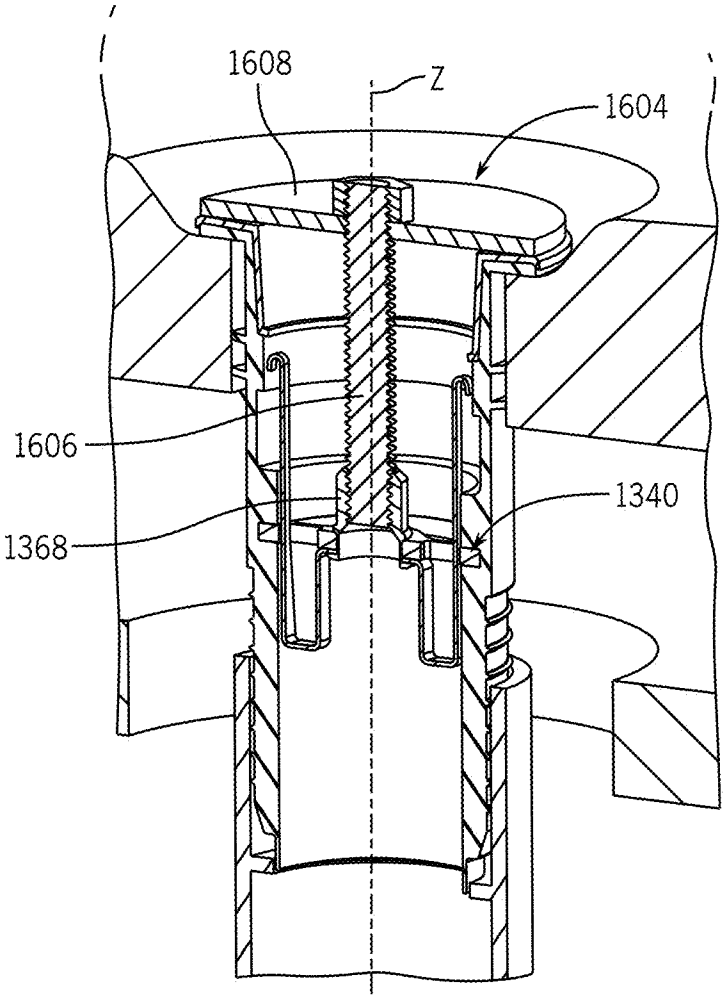
FIG. 16B shows a perspective, cross-sectional view of the blind drain installation assembly of FIG. 12 partially installed, including an installation fixture according to an example embodiment.
Figure 16A:
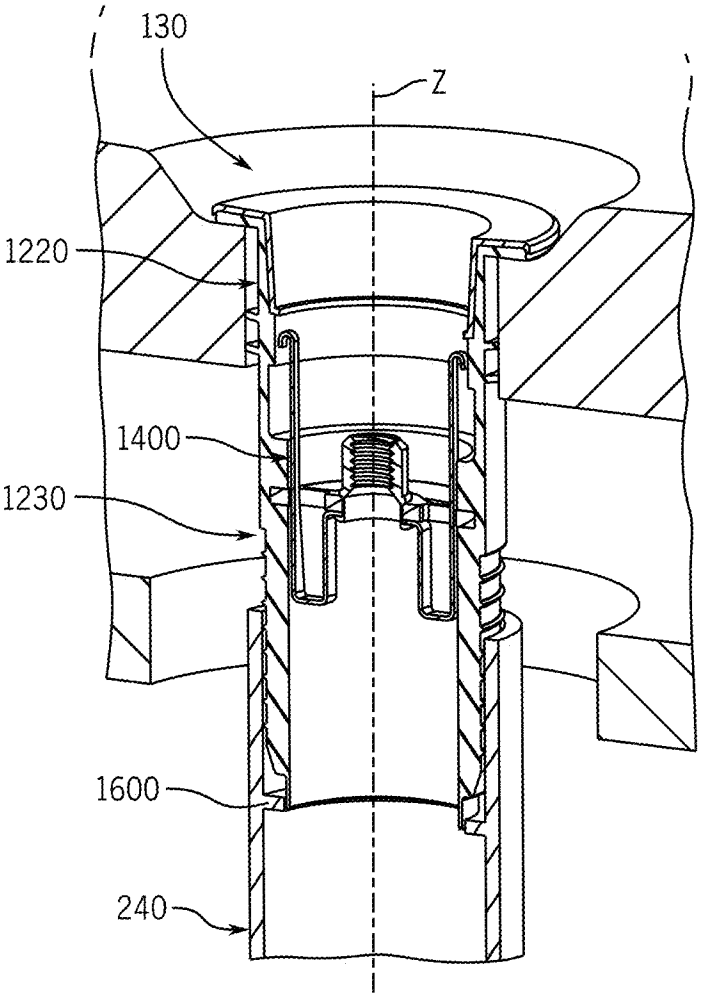
FIG. 16A shows a perspective, cross-sectional view of the blind drain installation assembly of FIG. 12 partially installed.

Referring to FIG. 16A, the drain coupling 1230 is inserted through the drain opening 130 from within the wash basin 100 (e.g., from above the top basin surface 110). The drain coupling 1230 is extended through the drain opening 130 and is received by the drain pipe 240 such that the first flange 1314 interfaces with the top basin surface 110. The first flange 1314 prevents the drain coupling 1230 from falling through the drain opening 130. The drain pipe 240 may include a drain pipe flange 1600, extending inward, toward the central axis Z, from an inner surface of the drain pipe 240. The drain pipe flange 1600 may interface with the drain coupling 1230 to prevent the drain coupling 1230 from sliding too far into the drain pipe 240. The drain pipe flange 1600 may behave similarly to the stop lip 1308*b*. As shown, it may not be necessary for the drain pipe flange 1600 to interface with the drain coupling 1230.

Once the drain coupling 1230 is inserted such that the first flange 1314 interfaces with the top basin surface 110, the drain body 1220 may be inserted into the drain coupling 1230. In some embodiments, the drain body 1220 is already coupled to the drain coupling 1230, such as by overmolding, prior to the drain coupling 1230 being inserted through the drain opening 130. In some embodiments, the drain body 1220 may be inserted into the drain coupling 1230 such that the first fixture projection 1350 is properly seated within (e.g., is received within) the first cut-out 1550, and the second fixture projection 1360 is properly seated within the second cut-out 1554, aligning the drain body 1220 within the drain coupling 1230. In some embodiments, the drain body 1220 is inserted into the drain coupling 1230 from the top side of the wash basin 100 until the third flange 1540 (e.g., the bottom third flange surface 1544) interfaces with the drain body catch 1311. When properly inserted, the first hook 1553 may be proximate, and in some instances interfacing with, the first fixture projection seat portion 1356, and the second hook 1557 may be proximate, and in some instances interfacing with, the second fixture projection seat portion 1366. More specifically, the first hook extrados 1562 may interface with the first fixture projection seat portion 1356 and the second hook extrados 1572 may interface with the second fixture projection seat portion 1366. In some embodiments, the drain body 1220 is fully seated when the second flange 1514 interfaces with the first flange 1314.

Turning now to FIG. 16B, after the drain coupling 1230 and the drain body 1220 are properly seated, an installation fixture 1604 is used to couple together the drain coupling 1230 and the drain body 1220. More specifically, the installation fixture 1604 is configured to bias the latch body 1400 toward the drain body 1220 along the central axis Z such that the first latch 1420 and the second latch 1440 clip onto the third flange 1540. In some embodiments, the installation fixture 1604 is configured to bias the latch body 1400 toward the drain body 1220 along the central axis Z such that the first latch 1420 and the second latch 1440 clip onto the first hook 1553 and the second hook 1557, respectively. The installation fixture 1604 includes a fastener 1606 and a fixture plate 1608. While the installation fixture 1604 described herein is an example embodiment, it should be understood that similar structures may be used in a similar fashion to couple the drain body 1220 to the drain coupling 1230 in a similar manner. The fixture plate 1608 defines an annular body having a diameter approximately equal to the twenty-sixth diameter $D_{26}$ and an orifice at the center (e.g., the fixture plate 1608 is a large metal washer). Through the orifice extends the fastener 1606. As shown, the fastener 1606 has a shank slidingly received within the fixture plate 1608, defining a diameter less than the orifice in the fixture plate 1608. The fastener 1606 further includes a head with a diameter greater than the orifice, preventing the fastener 1606 from falling through the orifice.

The fixture plate 1608 is placed over the drain body 1220, interfacing with the second flange 1514. The fastener 1606 is slid through the fixture plate 1608 and threaded into the nut 1368 from above. An installer may use a tool (e.g., wrench, screwdriver, pliers, etc.) to turn the fastener 1606, causing the nut 1368 to thread onto the fastener 1606 and transverse up the fastener 1606, along the central axis Z, in the direction of the fixture plate 1608. With the nut 1368 also moves the first lattice 1340 and the latch body 1400. More specifically, the first latch 1420 moves toward the first hook 1553 and the second latch 1440 moves toward the second hook 1557. Eventually, the first latch extrados 1422 and the first hook extrados 1562 may contact each other. The rounded profile of first hook 1553 biases the first finger 1416 toward the central axis Z as the latch body 1400 continues to travel upward, toward the fixture plate 1608. Similarly, the second latch extrados 1442 and the second hook extrados 1572 may contact each other. The rounded profile of second hook 1557 biases the second finger 1436 toward the central axis Z as the latch body 1400 continues to travel upward, toward the fixture plate 1608. Eventually, as the nut 1368 is further threaded up the fastener 1606, the first latch end 1426 will interface with the first hook end 1564 and the second latch end 1446 will interface with the second hook end 1574. Once the first latch end 1426 passes the first hook end 1564 (e.g., is traversed nearer to the top basin surface 110, beyond the first hook end 1564 as a result of the threading of the nut 1368) and the second latch end 1446 passes the second hook end 1574, the first finger 1416 will bias the first latch 1420 away from the central axis Z and the second finger 1436 will bias the second latch 1440 away from the central axis Z. The first latch end 1426 will be positioned above the first hook intrados 1560 and the second latch end 1446 will be positioned above the second hook intrados 1570. The installer should feel a sudden drop in resistance in the turning of the fastener 1606 once the pressure is released from the first finger 1416 and the second finger 1436. The installer may possibly hear a snap or a click when the first finger 1416 and the second finger 1436 fling into the first hook 1553 and the second hook 1557, respectively. In some embodiments, at this point in the installation, neither the first latch 1420 nor the second latch 1440 are properly seated. At this point, the installer may reverse the fastener 1606, causing the first latch 1420 and the second latch 1440 to move down, toward the drain pipe 240, eventually being properly seated with the first hook 1553 and the second hook 1557, respectively, as previously described. The installer may be able to feel when the first latch 1420 and the second latch 1440 are properly seated, as the fastener will begin to thread out of the nut 1368 and travel in a direction away from the drain pipe 240, along the central axis Z.

In some embodiments, such as shown in FIG. 16B, the drain body 1220 may not include the first hook 1553 or the second hook 1557. Instead, the first latch 1420 and the second latch 1440 may latch onto the third flange 1540. The third flange 1540 may be structured to act similarly to the first and second hooks 1553, 1557, defining an intrados for the first latch 1420 and the second latch 1440 to latch onto, and defining an extrados to bias the first finger 1416 and the second finger 1436 toward the central axis Z as the nut 1368 is threaded up the fastener 1606 during installation.

The movement of the nut 1368 toward the top basin surface 110 along the central axis Z is allowed because of the compliance of the drain coupling 1230. As the fastener 1606 is threaded into the nut 1368, the first lattice 1340 travels up, in the direction of the top basin surface 110, and squeezes the side walls of the drain coupling 1230 against the bottom basin surface 120. The drain body 1220, and more specifically the second flange 1514, may be compressed against the first flange 1314 as a result of the compliance of the drain coupling 1230 during installation. The second flange 1514 compresses the first flange 1314 into the top basin surface 110, forming a watertight seal between the top basin surface 110 and the first flange 1314. In some embodiments, a watertight seal may also be formed between the second flange 1514 and the first flange 1314.

Figure 16D:
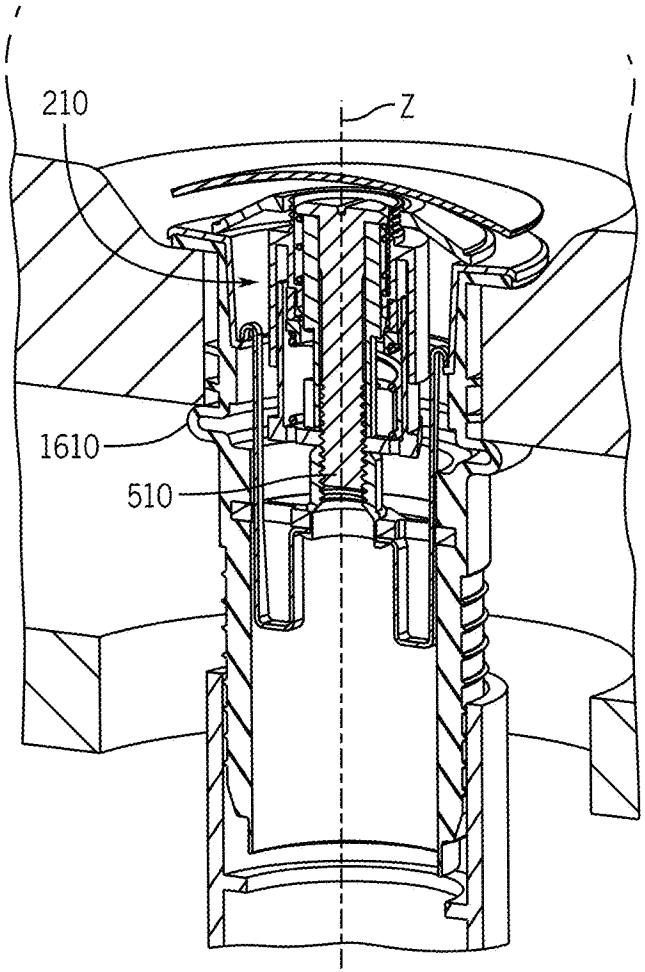
FIG. 16D shows a perspective, cross-sectional view of the blind drain installation assembly of FIG. 12 fully installed, including the toe tap.
Figure 16C:
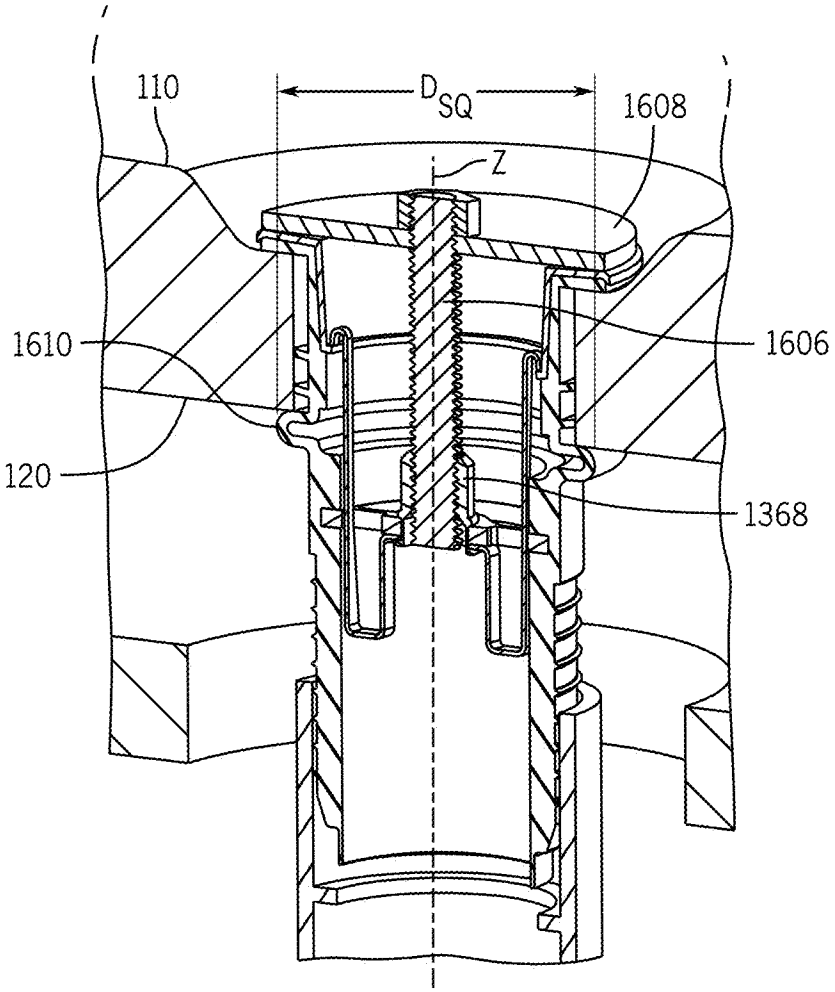
FIG. 16C shows a perspective, cross-sectional view of the blind drain installation assembly of FIG. 12 fully installed, including the installation fixture according to an example embodiment.

Shown in FIG. 16C is a squeeze bulge 1610 formed by the compliance of the drain coupling 1230. The squeeze bulge 1610 forms gradually as the fastener 1606 is threaded into the nut 1368. The first lower end 1306 may slide up the drain pipe 240, generally toward the wash basin 100, as the nut 1368 is threaded onto the fastener 1606, providing the extra slack within the drain coupling 1230 to form the squeeze bulge 1610. The squeeze bulge 1610 defines a diameter, shown as a squeeze bulge diameter $D_{SQ}$. The squeeze bulge diameter $D_{SQ}$ is greater than the drain opening diameter $D_1$. The squeeze bulge 1610 holds the drain coupling 1230, and thus the drain body 1220, within the drain opening 130. The squeeze bulge 1610 applies a downward force on the first lattice 1340, which applies a similar downward force on the latch body 1400. The latch body 1400 pulls down on the drain body 1220 via the first finger 1416 and the second finger 1436. The second flange 1514 of the drain body 1220 compresses the first flange 1314 of the drain coupling 1230 against the wash basin 100 to form a watertight seal. In short, once the first latch 1420 and the second latch 1440 are properly engaged with the drain body 1220 (e.g., the first hook 1553 and the second hook 1557), the installation fixture 1604 may be removed (e.g., unthreaded from the nut) without the blind drain installation assembly 1200 coming apart.

Turning now to FIG. 16D, the drain coupling 1230 and the drain body 1220 are fully installed within the drain pipe 240 and the drain opening 130. As a finishing touch, the toe tap 210 may be installed within the drain body 1220. In some embodiments, the toe tap 210 may utilize the nut 1368 to secure the toe tap 210 within the blind drain installation assembly 1200. Such a toe tap 210 may offer redundancy to the blind drain installation assembly 1200, applying an upward force on the first lattice 1340 and applying a downward force on the second flange 1514.

Figure 17B:
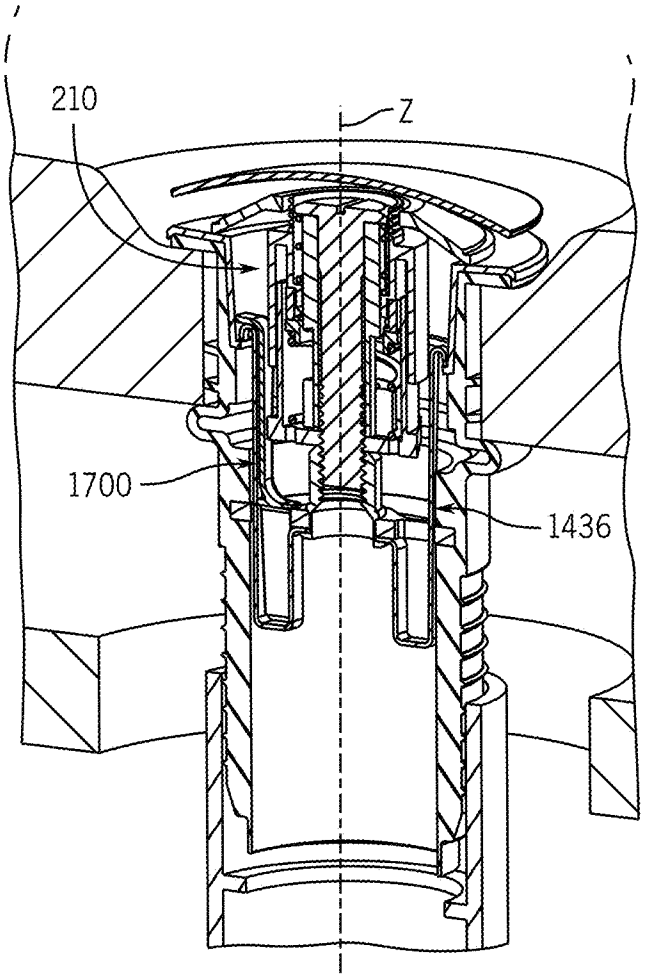
FIG. 17B shows a perspective, cross-sectional view of the finger cover of FIG. 17A installed in the blind drain installation assembly of FIG. 16D.
Figure 17A:
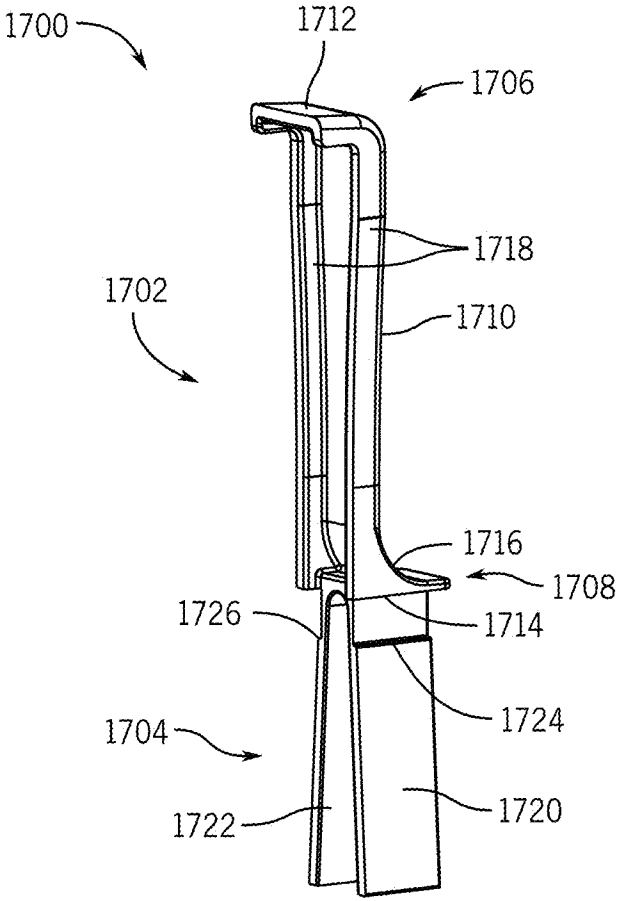
FIG. 17A shows a perspective view of a finger cover, according to an example embodiment.

Referring to FIGS. 17A and 17B, a finger guard 1700 is shown according to an example embodiment. The finger guard 1700 is configured to prevent foreign bodies, such as a hair catcher, strainer, snare, or similar product, from catching on and dislodging the latch body 1400 from the drain body 1220 when pulled in and out of the drain body 1220. The finger guard 1700 includes a cover portion 1702 and a cantilever portion 1704. The cover portion 1702 includes a first cover end 1706, and a second cover end 1708. The cover portion 1702 is coupled to the cantilever portion 1704 proximate the second cover end 1708. In some embodiments, the cover portion 1702 and the cantilever portion 1704 are integrally formed, such as through injection molding, 3D printing, die-casting, or similar manufacturing means.

Extending between the first cover end 1706 and the second cover end 1708 is a neck 1710. The neck 1710 is configured to protect (e.g., cover) the first finger 1416 from foreign bodies. In some embodiments, the neck 1710 may interface with the first finger 1416 once the blind drain installation assembly 1200 is assembled, as shown in FIG. 17B, to prevent the first finger 1416 from being biased toward the central axis Z and disengaging with the first hook 1553. In some embodiments, the neck 1710 does not interface with the first finger 1416.

Proximate the first cover end 1706, the neck 1710 may be coupled to a head 1712. The head 1712, once installed within the blind drain installation assembly 1200, may be configured to interface with the first latch 1420. In some embodiments, the head 1712 interfaces with the second inner surface 1510 of the drain body 1220, displacing the head 1712 apart from the first latch 1420 such that the head 1712 does not interface with the first latch 1420. The interface between the head 1712 and the neck 1710 may be chamfered or rounded to provide a smooth transition. The smooth transition may serve to prevent foreign bodies from attaching to and/or dislodging the finger guard 1700 from the blind drain installation assembly 1200.

Proximate the second cover end 1708, the finger guard 1700 includes a cover base surface 1714 configured to interface with the top first lattice surface 1342 to prevent movement of the finger guard 1700 in a direction generally toward the drain pipe 240. The finger guard 1700 also includes a cover base contour 1716 configured to dissipate stresses caused by forces on the finger guard 1700 in a direction generally toward the central axis Z. The finger guard 1700 may further include walls 1718 extending the length of the neck 1710 and the head 1712, the walls 1718 further configured to prevent access to the first finger 1416 by foreign bodies.

The cantilever portion 1704 may include a first cantilever 1720 and a second cantilever 1722. The first cantilever 1720 may include a first catch surface 1724. The first catch surface 1724 may be configured to interface with the bottom first lattice surface 1344 to prevent movement of the finger guard 1700 in a direction generally toward the top basin surface 110. A distance between the first catch surface 1724 and the cover base surface 1714 may be approximately equal to a thickness of the first lattice 1340. In some embodiments, the distance between the first catch surface 1724 and the cover base surface 1714 may be slightly greater than the thickness of the first lattice 1340, allowing for a bit of movement of the finger guard 1700 when installed. The second cantilever 1722 may include a second catch surface 1726, similar to the first catch surface 1724 and configured to interface with the bottom first lattice surface 1344 and configured to prevent movement of the finger guard 1700 in a direction generally toward the top basin surface 110.

Turning now to FIG. 17B, the blind drain installation assembly 1200 further including the finger guard 1700. As shown, the finger guard 1700 is positioned around the first finger 1416. However, it should be understood that the finger guard 1700 may be positioned around both the first finger 1416 and the second finger 1436.

The finger guard 1700, when used and installed in cooperation with the blind drain installation assembly 1200, may be installed after the installation fixture 1604 has been removed, but before the top tap 210 has been inserted within the drain body 1220. The finger guard 1700 is inserted, from above (e.g., within the wash basin 100), such that the cantilever portion 1704 extends through the lattice slot 1370. More specifically, the first cantilever 1720 and the second cantilever 1722 are biased toward one another such that both the first cantilever 1720 and the second cantilever 1722 may be extended through the lattice slot 1370. The cantilever portion 1704 is properly set within the lattice slot 1370 when both the first catch surface 1724 and the second catch surface 1726 are biased away from one another and interface with the bottom first lattice surface 1344. In some embodiments, the finger guard 1700 is properly set when the cover base surface 1714 interfaces with the top first lattice surface 1342. In some embodiments, the finger guard 1700 is properly set when both of the previous conditions are met.

Once the finger guard 1700 is installed, the first cantilever 1720 and the second cantilever 1722 act as covers for the first compliant portion 1412. The first cantilever 1720 and the second cantilever 1722 may serve to prevent build-up of debris from collecting on the first compliant portion 1412 and inhibiting movement of the first finger 1416.

Figure 18:
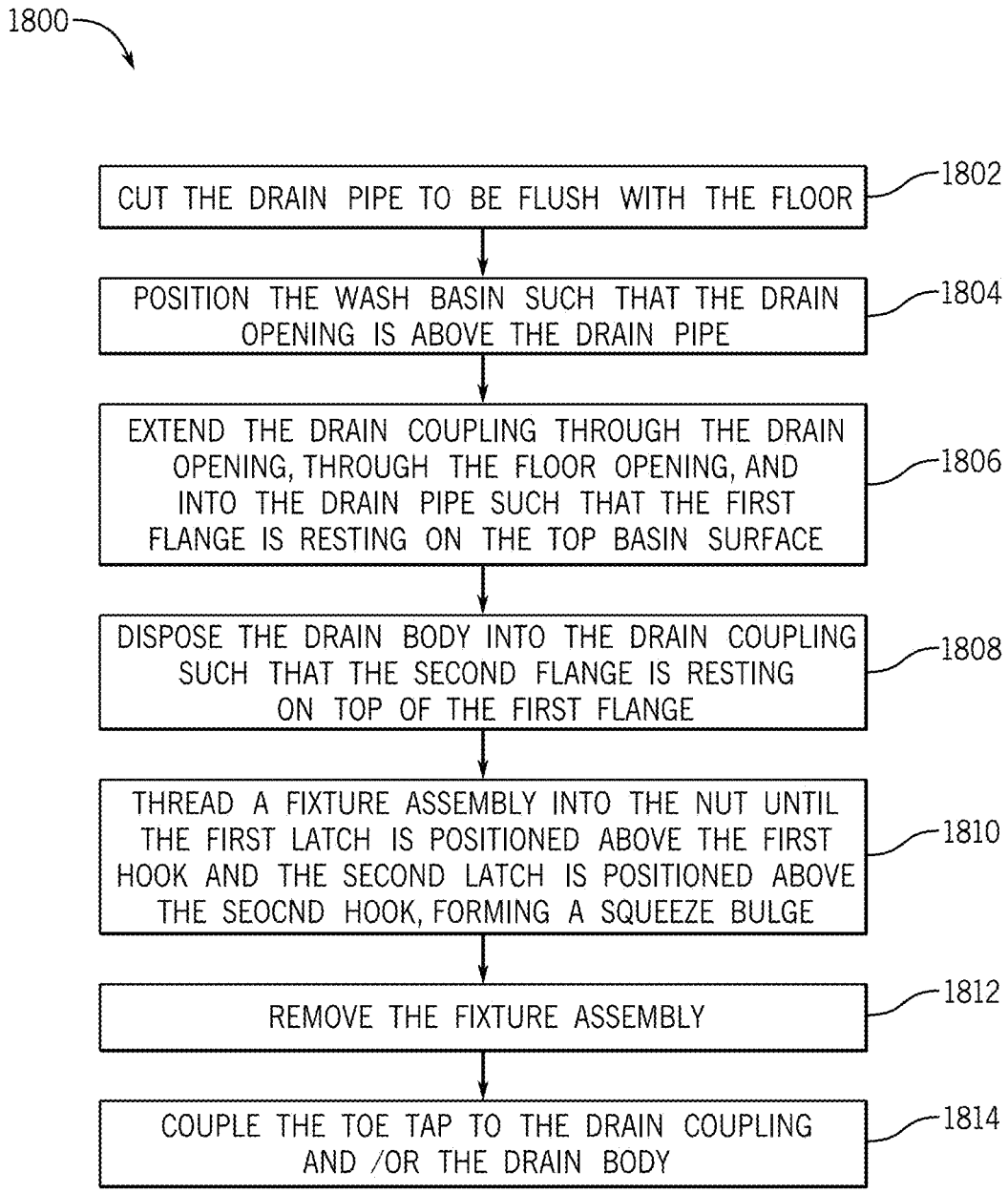
FIG. 18 a method of installing the blind drain installation assembly of FIG. 12, according to an exemplary embodiment.

Turning to FIG. 18, a method 1800 of installing the blind drain installation assembly 1200 is shown. The method 1800 is similar to the method 1100. A difference between the two methods is that in method 1800, the drain body 1220 is coupled to the drain coupling 1230 using an installation fixture, such as the installation fixture 1604.

To begin installation, at 1802, the drain pipe 240 that extends through the floor opening 107 is cut such that the top drain pipe portion 245 is flush with the top of the floor 105. At 1804, the wash basin 100 is then positioned on the floor 105 and above the drain pipe 240 such that the drain pipe 240 and the drain opening 130 are lined up (e.g., concentric about each other).

At 1806, the drain coupling 1230 is extended through the drain opening 130 and extended through the drain pipe 240. The drain coupling 1230 extends through the floor opening 107 and below the floor 105. The first lattice 1340 is positioned between the drain opening 130 and the top drain pipe portion 245. In some embodiments, the top drain pipe portion 245 may be disposed below the floor 105. In such embodiments, the first lattice 1340 may be positioned below the floor 105. The first flange 1314 rests on the top basin surface 110 such that the drain coupling 1230 does not fall through the drain opening 130.

At 1808, the drain body 1220 is disposed within the drain coupling 1230 such that the second flange 1514 rests on top of the first flange 1314. Further, the latch body 1400 is positioned below the drain body 1220. In some embodiments, the drain body 1220 interfaces with the first fixture projection 1350 second fixture projection 1360 to align the drain body 1220 within the drain coupling 1230 such that, for example, the first overflow aperture 1365 is aligned with the second overflow aperture 1580. In some embodiments, the first fixture projection 1350 and the second fixture projection 1360 interface with the drain body 1220 to prevent rotational movement of the drain body 1220 about the central axis Z relative to the drain coupling 1230.

At 1810, the installation fixture 1604 (or a similar installation fixture) is extended through the drain body 1220 and the drain coupling 1230 from above (e.g., from within the wash basin 100). The installation fixture 1604 interfaces with the second flange third surface 1520, and threads into the nut 1368. As the installation fixture 1604 is threaded into the nut 1368, the nut 1368 traverses up the installation fixture 1604, bringing with it the first lattice 1340 and the latch body 1400. The installation fixture 1604 is threaded into the nut 1368 until the first latch 1420 is positioned above the first hook 1553 and the second latch 1440 is positioned above the second hook 1557. In some embodiments, in which the drain body 1220 does not include the first hook 1553 or the second hook 1557, the installation fixture 1604 is threaded into the nut 1368 until the first latch 1420 and the second latch 1440 are positioned above the third flange 1540. The movement of the first lattice 1340 toward the wash basin 100 forms the squeeze bulge 1610 within the drain coupling 1230.

At 1812, the installation fixture is removed from the drain coupling 1230 and the drain body 1220 (e.g., unthreaded from the nut 1368).

At 1814, the toe tap 210 is operably coupled to the blind drain installation assembly 1200. In some embodiments, the toe tap includes the toe tap fastener 510, configured to threading couple to the nut 1368.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled to each other, with the two members coupled with a separate intervening member and any additional intermediate members coupled with one another, or with the two members coupled together with an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shelf assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. Any element disclosed in one embodiment may be incorporated or utilized with any other embodiment disclosed herein. Although one example of an element that can be incorporated or utilized in another embodiment has been described above, it should be appreciated that other elements of the various embodiments may be incorporated or utilized with any of the other embodiments disclosed herein.

Other substitutions, modifications, changes and omissions may also be made in the design, operating conditions and arrangement of the various exemplary embodiments without departing from the scope of the present invention. For example, any element (e.g., arm, shelf member, fastener, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A drain installation assembly comprising:

a coupling configured to be inserted into a drain opening of a wash basin from a top side of the wash basin, the coupling comprising a wall having a squeeze portion formed in the wall and positioned between opposing ends of the coupling; and a body comprising a flange extending radially away from the body;

wherein the wall of the coupling at the squeeze portion is configured to deform when the coupling is coupled to the body to secure the coupling to the wash basin.

2. The drain installation assembly of claim 1, wherein, when the squeeze portion is deformed, the squeeze portion has a diameter greater than a diameter of the drain opening of the wash basin.

3. The drain installation assembly of claim 1, wherein the squeeze portion is formed from at least one of rubber or neoprene.

4. The drain installation assembly of claim 1, wherein the wall of the coupling at the squeeze portion is thinner than the wall at other portions of the coupling.

5. The drain installation assembly of claim 1, further comprising:

a latch body coupled to the coupling between the opposing ends of the coupling;

wherein the latch body includes a ring and a finger extending away from the ring; and wherein the finger of the latch body is configured to couple to the body.

6. The drain installation assembly of claim 5, wherein:

the latch body further comprises a lattice coupled to the finger; and the lattice is configured to apply a force to the squeeze portion to deform the squeeze portion when the finger of the latch body is coupled to the body.

7. The drain installation assembly of claim 6, wherein movement of the lattice toward the wash basin applies the force to the squeeze portion to deform the squeeze portion.

8. The drain installation assembly of claim 5, further comprising a fastener configured to couple with the latch body, wherein the squeeze portion is configured to deform responsive to the fastener coupling to the latch body.

9. The drain installation assembly of claim 1, wherein the flange of the body is configured to couple with the coupling.

10. A drain assembly for coupling a wash basin to a drain pipe from above the wash basin, the drain assembly comprising:

a coupling configured to be inserted into a drain opening of the wash basin from a top side of the wash basin, the coupling comprising a wall having a squeeze portion formed in the wall and positioned between opposing ends of the coupling; and a body comprising a flange;

wherein the wall of the coupling at the squeeze portion is formed of a flexible material and is configured to deform when the coupling is coupled to the body.

11. The drain assembly of claim 10, wherein, when the squeeze portion is deformed, the squeeze portion has a diameter greater than a diameter of the drain opening of the wash basin.

12. The drain assembly of claim 10, wherein the wall of the coupling at the squeeze portion is thinner than the wall at other portions of the coupling.

13. The drain assembly of claim 10, further comprising:

a latch body coupled to the coupling between the opposing ends of the coupling;

wherein the latch body includes a ring, a finger extending away from the ring, and a lattice coupled to the finger;

wherein the finger of the latch body is configured to couple to the body; and wherein the lattice is configured to apply a force to the squeeze portion to deform the squeeze portion when the finger of the latch body is coupled to the body.

14. The drain assembly of claim 13, wherein movement of the lattice toward the wash basin applies the force to the squeeze portion to deform the squeeze portion.

15. The drain assembly of claim 13, further comprising a fastener configured to couple with the latch body, wherein the squeeze portion is configured to deform responsive to the fastener coupling to the latch body.

16. A method of installing a drain assembly to a wash basin, the method comprising:

inserting a coupling into a drain opening in the wash basin from a top side of the wash basin, the coupling comprising a wall having a squeeze portion formed in the wall and positioned between opposing ends of the coupling;

inserting a body into the coupling; and causing the wall of the coupling at the squeeze portion to deform to secure the coupling to the wash basin.

17. The method of claim 16, further comprising, before inserting the body into the coupling, extending the coupling into a drain pipe.

18. The method of claim 16, wherein, when the squeeze portion is deformed, the squeeze portion has a diameter greater than a diameter of the drain opening of the wash basin.

19. The method of claim 16, wherein the wall of the coupling at the squeeze portion is thinner than the wall at other portions of the coupling.

20. The method of claim 16, further comprising:

coupling a latch body to the body;

wherein causing the squeeze portion of the coupling to deform comprises compressing the squeeze portion between the wash basin and the latch body.

* * * * *